US009346292B2

(12) United States Patent
Nakano et al.

(10) Patent No.: US 9,346,292 B2
(45) Date of Patent: May 24, 2016

(54) RECORDING APPARATUS

(71) Applicant: SEIKO EPSON CORPORATION, Tokyo (JP)

(72) Inventors: Yosuke Nakano, Shiojiri (JP); Atsuhiko Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/851,596

(22) Filed: Mar. 27, 2013

(65) Prior Publication Data

US 2013/0257960 A1 Oct. 3, 2013

(30) Foreign Application Priority Data

Mar. 30, 2012 (JP) ..... 2012-079656

(51) Int. Cl.

| | |
|---|---|
| ***B41J 2/01*** | (2006.01) |
| ***B41J 11/02*** | (2006.01) |
| ***B41J 11/00*** | (2006.01) |
| ***B41J 13/10*** | (2006.01) |

(52) U.S. Cl.

CPC ..... *B41J 11/02* (2013.01); *B41J 11/002* (2013.01); *B41J 13/106* (2013.01)

(58) Field of Classification Search

USPC ..... 347/16, 104, 5, 9

See application file for complete search history.

(56) References Cited

U.S. PATENT DOCUMENTS

| | | | | |
|---|---|---|---|---|
| 7,070,350 | B2 | 7/2006 | Inokuchi et al. | |
| 2005/0052518 | A1* | 3/2005 | Kagami | 347/104 |
| 2005/0162494 | A1 | 7/2005 | Inokuchi et al. | |

FOREIGN PATENT DOCUMENTS

| | | |
|---|---|---|
| JP | 60-085552 | 6/1985 |
| JP | 63-035756 | 3/1988 |
| JP | 2-267567 | 11/1990 |
| JP | 10-258962 | 9/1998 |
| JP | 2004-338873 | 12/2004 |
| JP | 2006-001705 | 1/2006 |

* cited by examiner

*Primary Examiner* — Lam Nguyen
(74) *Attorney, Agent, or Firm* — Workman Nydegger

(57) ABSTRACT

A discharged sheet reception tray is displaced between a most protruded position which protrudes most and an accommodation position which is accommodated inside an apparatus. Since a control unit switches the positions of the discharged sheet reception tray depending on a length of a sheet to be discharged, taking the sheet from the discharged sheet reception tray is easily improved. Specifically, since a drive unit driving the discharged sheet reception tray is controlled so that a leading edge of the discharged sheet protrudes by a predetermined amount from the discharged sheet reception tray, it is possible to easily take the sheet from the discharged sheet reception tray by picking up the leading edge of the sheet.

8 Claims, 19 Drawing Sheets

RECORDING APPARATUS

BACKGROUND

1. Technical Field

The present invention relates to a recording apparatus including a medium reception tray that receives a medium which is recorded and then discharged.

2. Related Art

As an example of a recording apparatus, a printer includes a discharged sheet reception tray (called a discharged sheet stacker or the like, but hereinafter, referred to as a "tray") that receives a medium (for example, a recording sheet), which is recorded and then discharged so that recording sheets which have been recorded are sequentially stacked on the tray.

There is a case where the tray is configured to be a multi-stage type such that a space to be occupied is minimized when not in use, and on the other hand, a surface receiving the recording sheets can be widely deployed when in use (for example, refer to JP-A-2006-001705).

Incidentally, there are various sizes of the sheet to be discharged, and in a case where a length of the sheet is long, since a leading edge of the sheet protrudes to some extent from a leading edge of the tray, a user is able to easily pick the leading edge of the sheet, that is, it is relatively easy to take the sheet. However, in a case where the length of the sheet is short, since the leading edge of the sheet does not protrude from the leading edge of the tray, there is a case where the sheet comes into close contact with a top surface of the tray so that the sheet is hard to be taken, and particularly, there is a possibility that a small size sheet having a high rigidity, such as a postcard, is harder to be picked up, and accordingly the sheet may be crumpled in a case of the sheet being taken out by force. Furthermore, in a case where the sheet is short, since the leading edge of the sheet does not protrude from the leading edge of the tray, the user disadvantageously has difficulties in awaring that the sheet is present on the tray.

Furthermore, in a case where the tray is configured to be switched using a power of a motor, from an accommodation state where the tray is accommodated inside the recording apparatus to a protrusion state where the tray protrudes from the recording apparatus, the tray is drawn into the apparatus in a state where the discharged sheet is remains placed on the tray. As a result, the sheet is also drawn into the apparatus together with the tray, and thereby there is a possibility that a sheet jam may occur.

SUMMARY

An advantage of some aspects of the invention is to further improve taking the sheet discharged on the tray. In addition, another advantage of the invention is to prevent the sheet from being drawn into an apparatus in a case where a configuration is employed in which the tray is moved using a power of a motor.

According to an aspect of the invention, there is provided a recording unit that performs a recording on a medium; a discharge unit that discharges the medium on which the recording is performed by the recording unit; a medium reception tray that is provided to be capable of displacing between a first position protruding in a medium discharge direction and a second position drawn in an opposite direction to the medium discharge direction and receives the medium discharged by the discharge unit; a drive unit that drives the medium reception tray; and a control unit that controls the drive unit so as to hold the medium reception tray at the first position at least until a discharge operation of the medium is completed by the discharge unit and so as to switch the medium reception tray from the first position to the second position after the discharge operation is completed.

In this case, after the discharge operation of the medium is completed, since the control unit controlling the drive unit which drives the medium reception tray switches the medium reception tray from the first position, that is, a protruded side position to the second position, that is, a drawn side position. Therefore, in a case where the medium has a predetermined size, the leading edge of the medium is allowed to protrude from the leading edge of the medium reception tray, and thereby taking the sheet from the medium reception tray may be easily improved.

According to the aspect, in a case where a length of the medium is shorter than a predetermined length, the control unit may not switch the medium reception tray from the first position to the second position and may hold the tray at the first position after the discharge operation is completed.

In this case, when the length of the medium is shorter than the predetermined length, after the discharge operation is completed, the control unit may not switch the medium reception tray from the first position to the second position and may hold the tray at the first position. Therefore, in a case where the length of the medium is long, when the medium reception tray is switched to the accommodation position, the medium may be prevented from falling down from the medium reception tray.

According to the aspect, when the medium reception tray is displaced in a direction from the first position toward the second position, a regulation unit may be included, in which drawing of the sheet is regulated by engaging with a trailing edge of the medium.

In this case, when the medium reception tray is displaced in a direction from the first position toward the second position, that is, when being displaced in the direction drawn into an apparatus, since a regulation unit is provided to be engaged with the trailing edge of the medium so as to regulate the medium being drawn, it is possible to prevent jam occurring due to the medium being drawn into the apparatus together with the medium reception tray.

According to the aspect, the regulation unit may be configured to include a tray side rib which is formed along the medium discharge direction in the medium reception tray, and a concave groove into which the tray side rib is fitted in a tray accommodation unit which accommodates the medium reception tray.

In this case, the regulation unit is configured to include the tray side rib which is formed along the medium discharge direction in the medium reception tray, and the concave groove into which the tray side rib is fitted, in the tray accommodation unit which accommodates the medium reception tray, the recording unit may have a simplified structure, which enables a low cost configuration.

According to the aspect, the recording apparatus has a configuration such that a ridge-like unit rising in a height direction from a medium reception surface which receives the medium are formed at both sides in an intersecting direction to the medium discharge direction, downstream in the medium discharge direction in the medium reception tray, in which an inclined guide surface is formed upstream in the medium discharge direction in the ridge-like unit, and an opening portion is formed on the inclined guide surfaces, in which a leading edge of the medium having a width greater than a predetermined width is configured to ride across the inclined guide surface, and the leading edge of the medium having a width less than a predetermined width is configured to enter the opening unit.

In this case, when the width of the medium is less than the predetermined width, since the leading edge of the medium is configured to enter the opening unit, the medium is substantially linearly discharged until the discharge operation is completed and thereby when the recording is performed on a small size medium having a high rigidity, such as a post card and a business card, a substantially linear posture of the medium may be held, and accordingly a preferable recording result may be obtained by preventing back-tension (transportation load) occurring.

According to another aspect of the invention, there is provided a method of controlling a recording apparatus, the recording apparatus including: a recording unit that performs recording on a medium; a discharge unit that discharges the medium on which the recording is performed by the recording unit; a medium reception tray that is provided to be capable of displacing between a first position protruding in a medium discharge direction and a second position drawn in an opposite direction to the medium discharge direction and receives the medium discharged by the discharge unit; a drive unit that drives the medium reception tray; and a control unit that controls the drive unit, the control unit including control methods of; receiving a recording execution command, determining a current position of the medium reception tray, starting a printing operation by moving the medium reception tray to a position where a leading edge of the medium protrudes by a predetermined amount from the leading edge of the medium reception tray, based on size information of the medium.

In this case, since the control unit causes the medium reception tray to move to the position where the leading edge of the medium protrudes by the predetermined amount from the leading edge of the medium reception tray, based on the size information of the medium, taking the medium from the medium reception tray may be easily improved.

According to still another aspect of the invention, there is provided a method of controlling a recording apparatus, the recording apparatus including: a recording unit that performs recording on a medium; a discharge unit that discharges the medium on which the recording is performed by the recording unit; a medium reception tray that is provided to be capable of displacing between a first position protruding in a medium discharge direction and a second position drawn in an opposite direction to the medium discharge direction and receives the medium discharged by the discharge unit; a drive unit that drives the medium reception tray; and a control unit that controls the drive unit, the control unit including control methods of; receiving a recording execution command, determining a current position of the medium reception tray, starting a recording operation by switching the medium reception tray to the first position, and moving the medium reception tray to a position where a leading edge of the medium protrudes by a predetermined amount from the leading edge of the medium reception tray, based on size information of the medium after the recording operation is completed.

In this case aspect, since the control unit causes the medium reception tray to move to the position where the leading edge of the medium protrudes by the predetermined amount from the leading edge of the medium reception tray, based on the size information of the medium, taking the medium from the medium reception tray may be easily improved.

According to still another aspect of the invention, there is provided a method of controlling a recording apparatus, the recording apparatus including: a recording unit that performs recording on a medium; a discharge unit that discharges the medium on which the recording is performed by the recording unit; a medium reception tray that is provided to be capable of displacing between a first position protruding in a medium discharge direction and a second position drawn in an opposite direction to the medium discharge direction and receives the medium discharged by the discharge unit; a drive unit that drives the medium reception tray; and a control unit that controls the drive unit, the control unit including control methods of; receiving a recording execution command, determining a current position of the medium reception tray, starting a recording operation by switching the medium reception tray to the first position, determining whether a length of the medium is less than a predetermined length after the recording operation is completed, and switching the medium reception tray to the second position if the length of the medium is less than the predetermined length.

In this case, after the recording operation is completed, since the control unit determines whether the length of the medium is less than the predetermined length, based on the size information of the medium, and switches the medium reception tray to the second position, if the length of the medium is less than the predetermined length. Therefore, taking the medium from the medium reception tray may be easily improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings, but the invention is not limited to the embodiments described below, and may be variously modified within the scope of the invention described in claims. On the premise that such modifications are also included within the scope of the invention, an embodiment of the invention will be described below.

Figure 1:
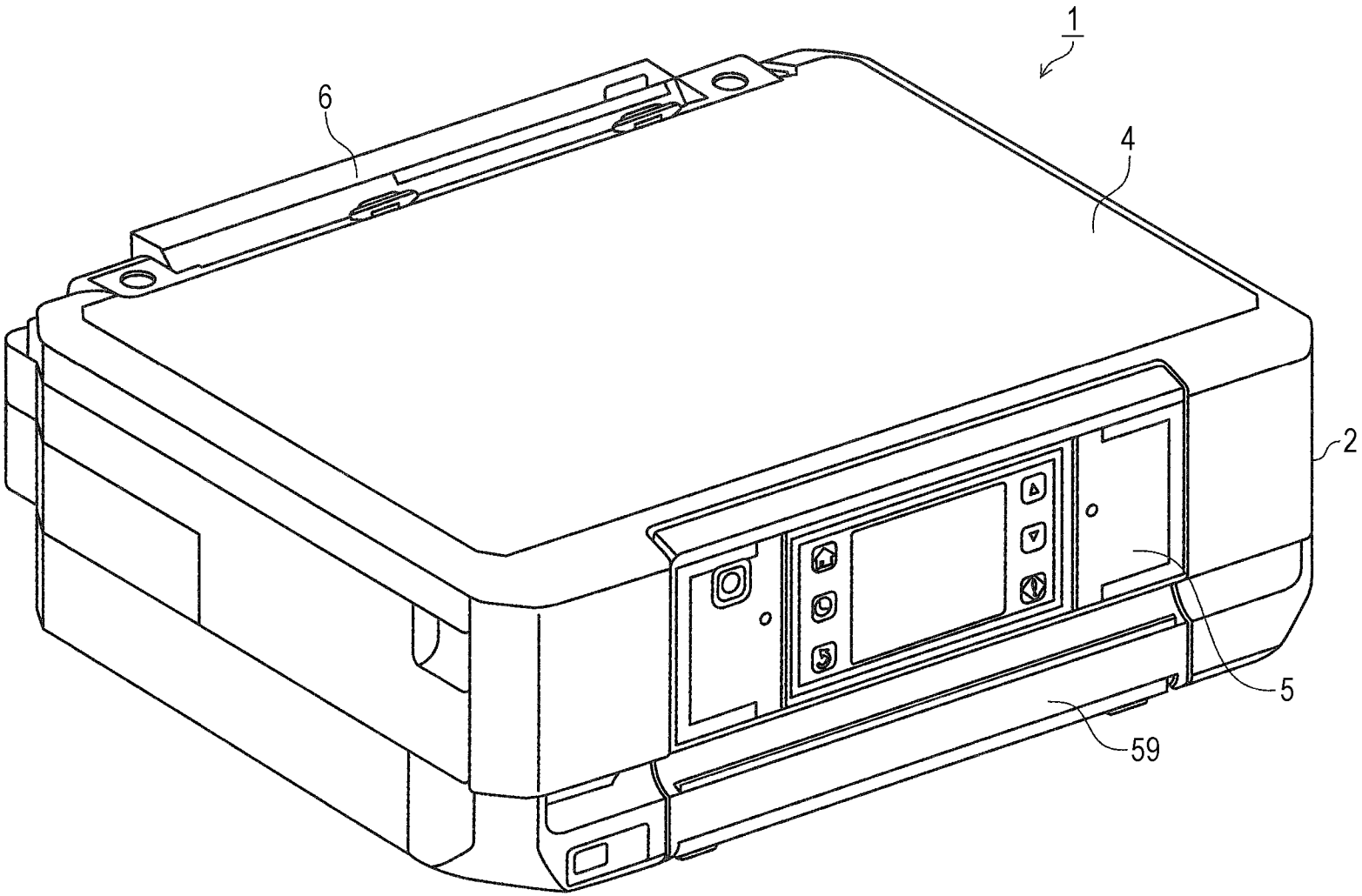
FIG. 1 is an external perspective view of a printer according to the invention.
Figure 2:
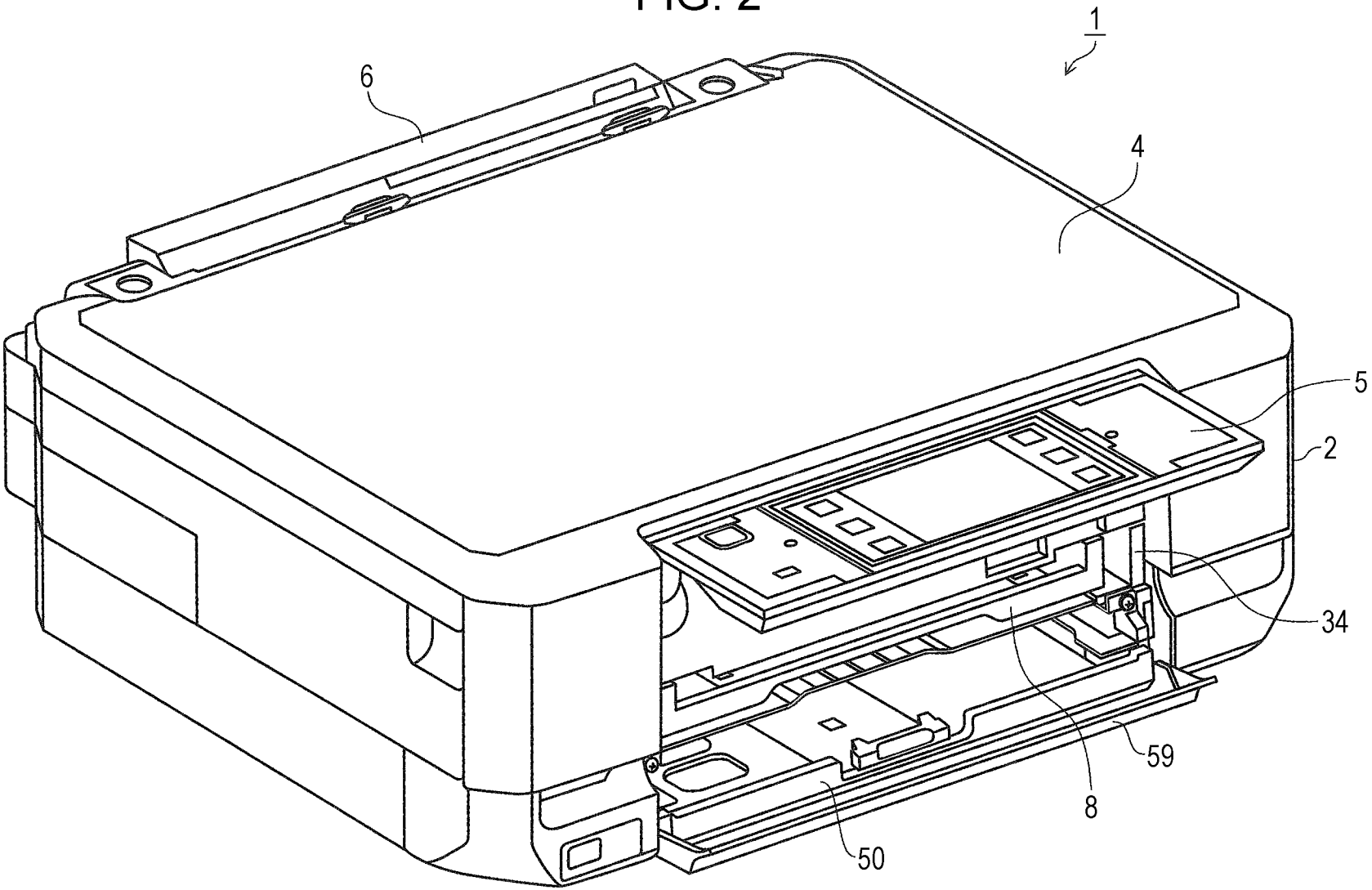
FIG. 2 is an external perspective view of the printer according to the invention.
Figure 3:
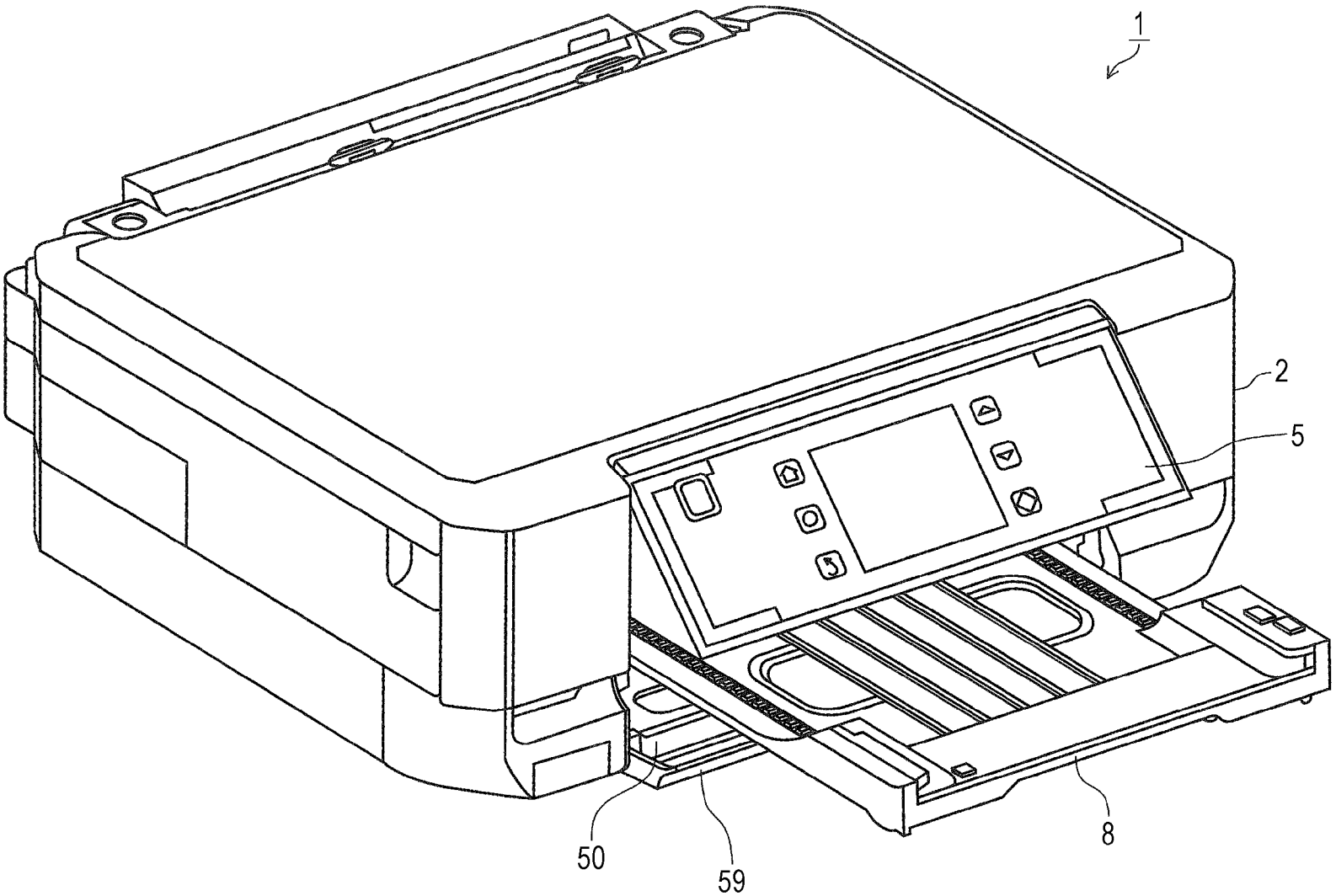
FIG. 3 is an external perspective view of a printer according to the invention.
Figure 4:
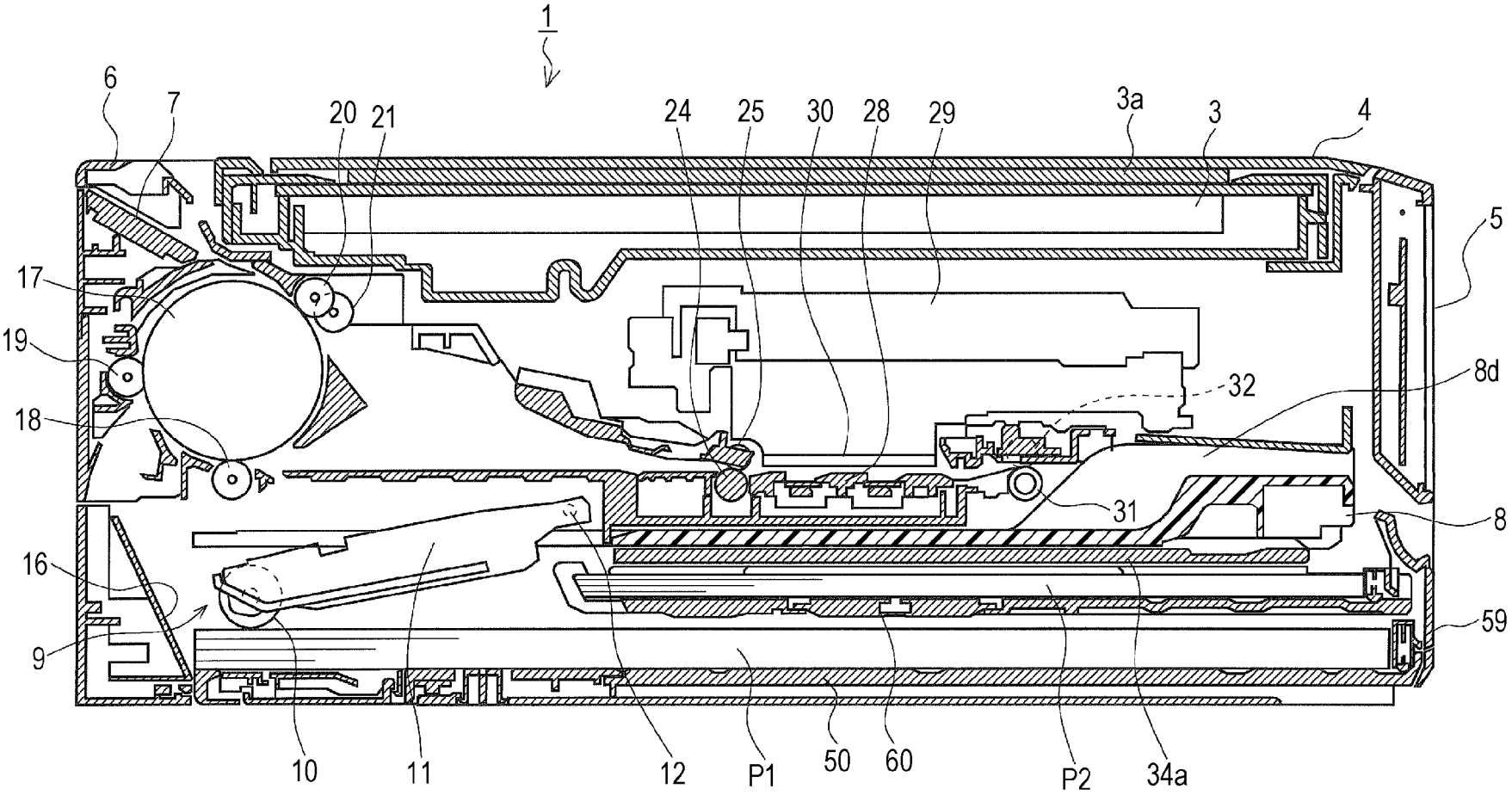
FIG. 4 is a side cross-sectional view illustrating a sheet transportation path of the printer according to the invention.
Figure 5:
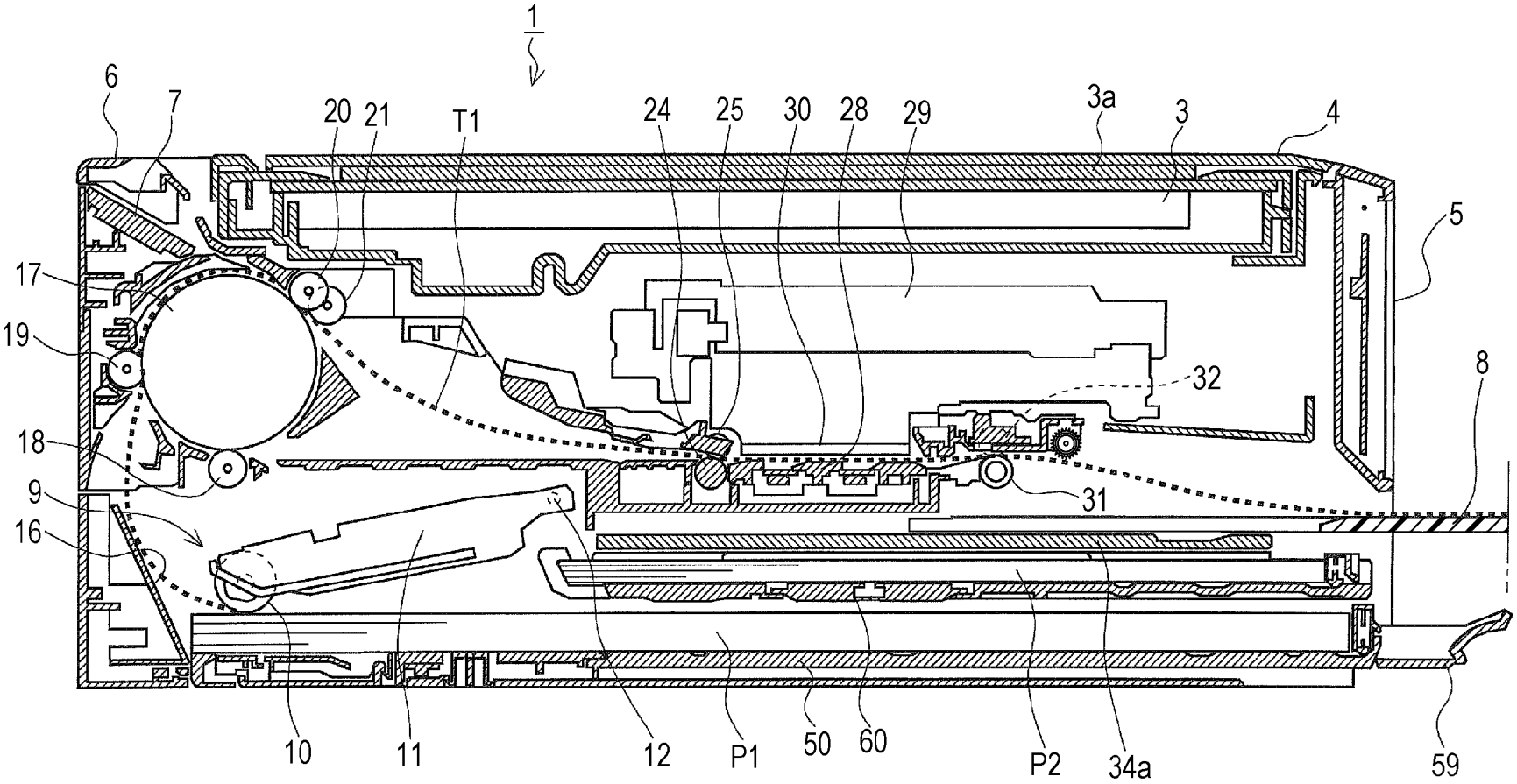
FIG. 5 is a side cross-sectional view illustrating a sheet transportation path of the printer according to the invention.
Figure 6:
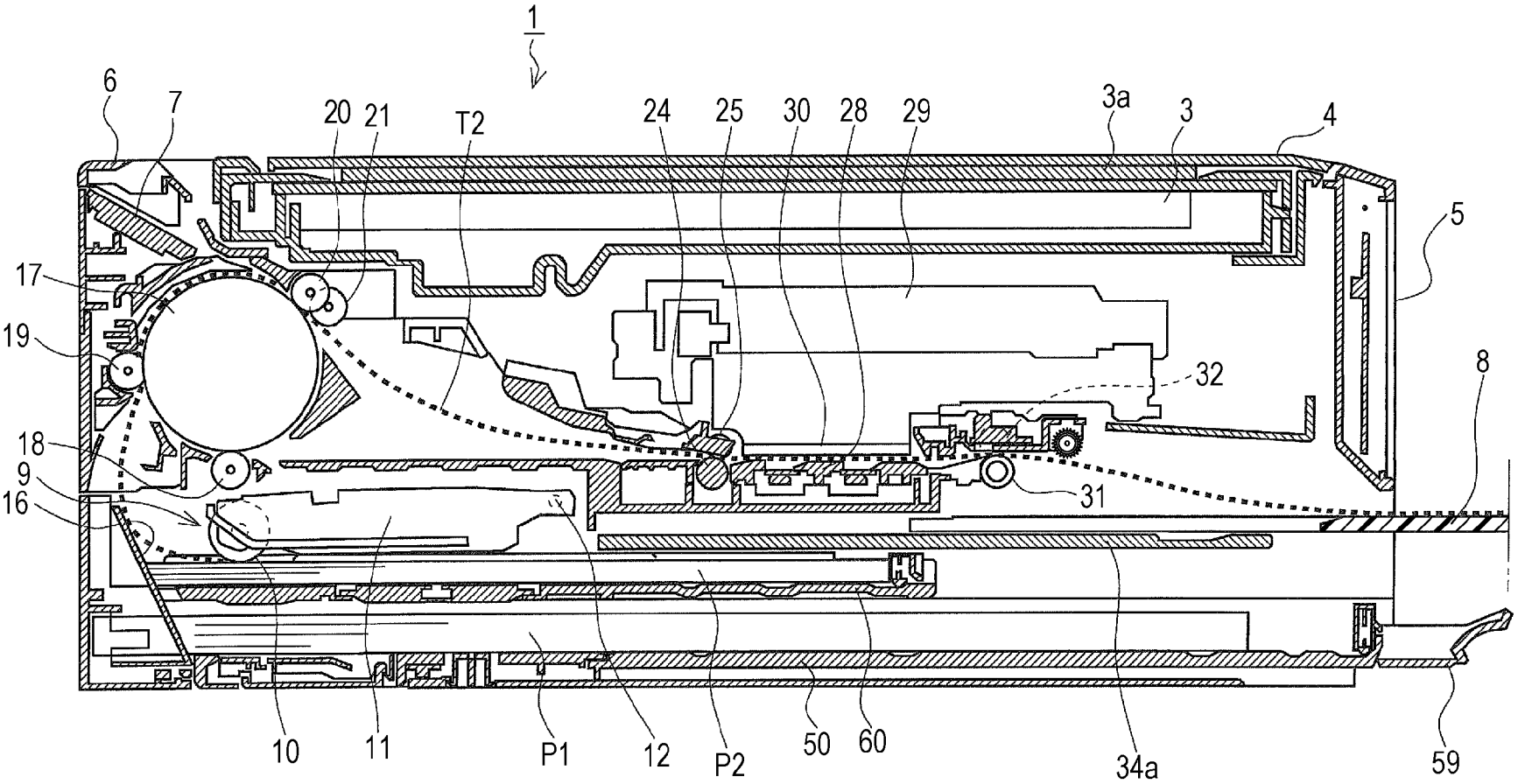
FIG. 6 is a side cross-sectional view illustrating a sheet transportation path of the printer according to the invention.
Figure 7:
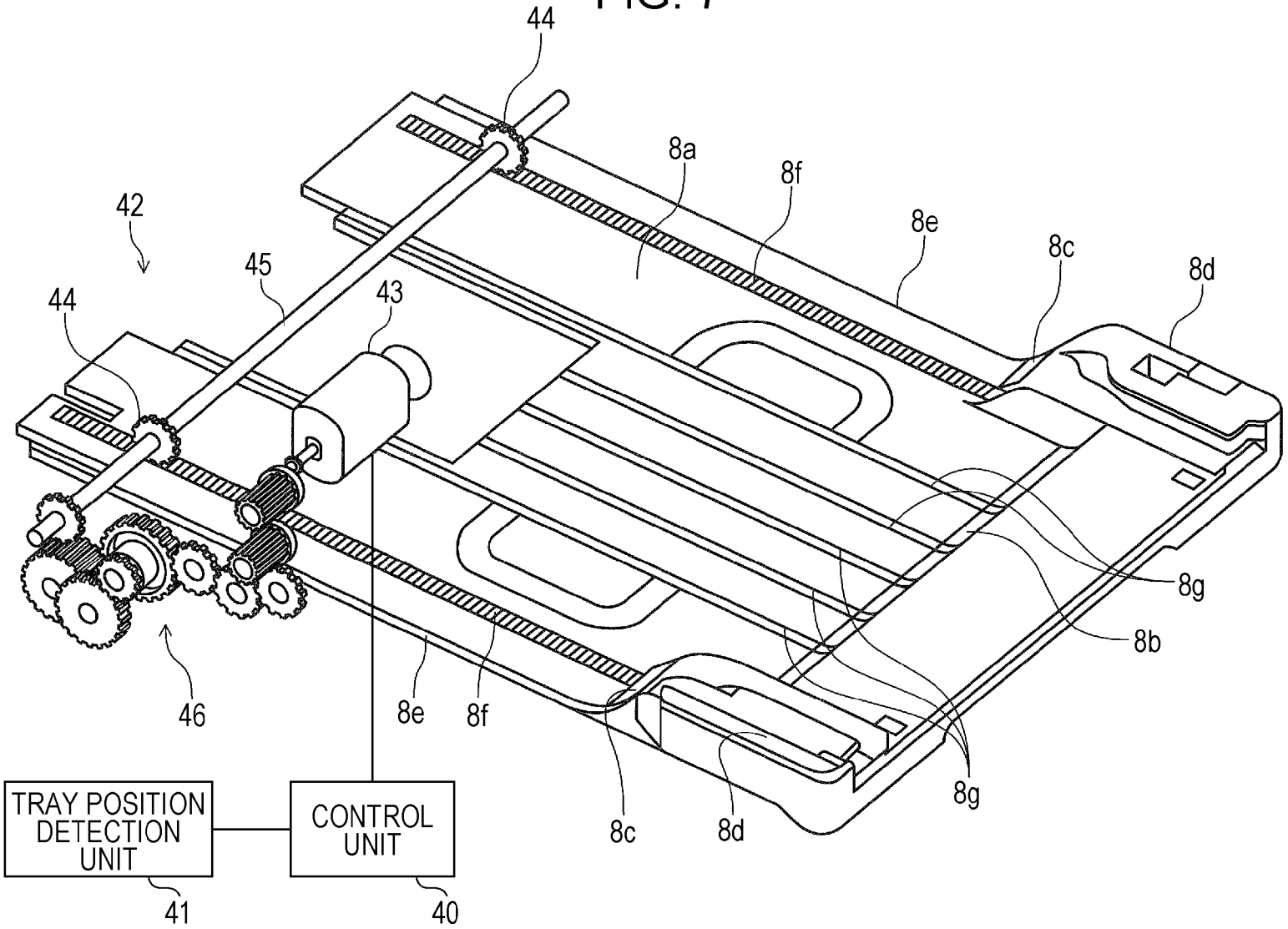
FIG. 7 is a perspective view of a drive unit driving a discharged sheet reception tray, and the discharged sheet reception tray.
Figure 8:
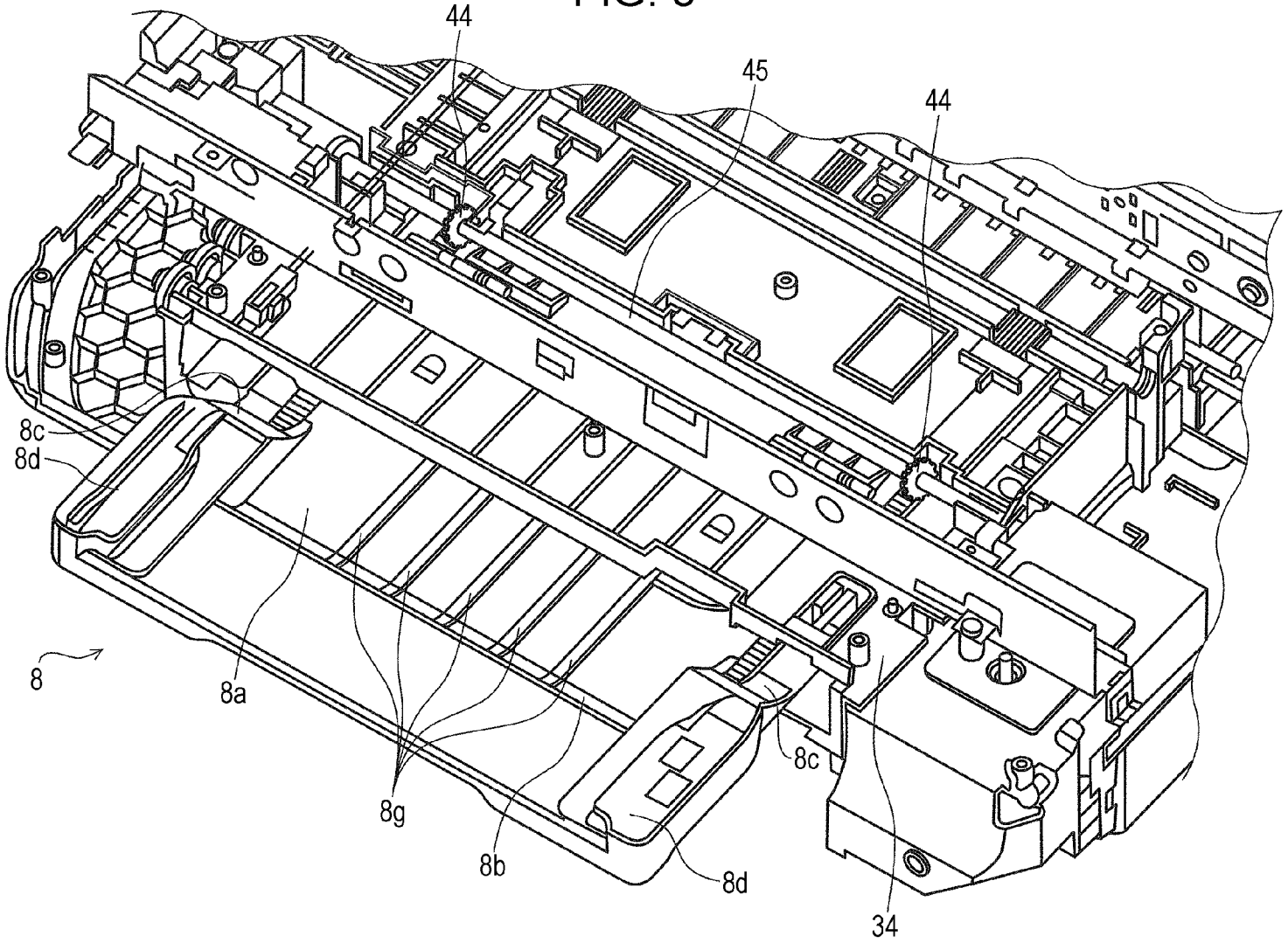
FIG. 8 is a perspective view illustrating a state where the discharged sheet reception tray protrudes from a frame configuring an apparatus body.
Figure 9:
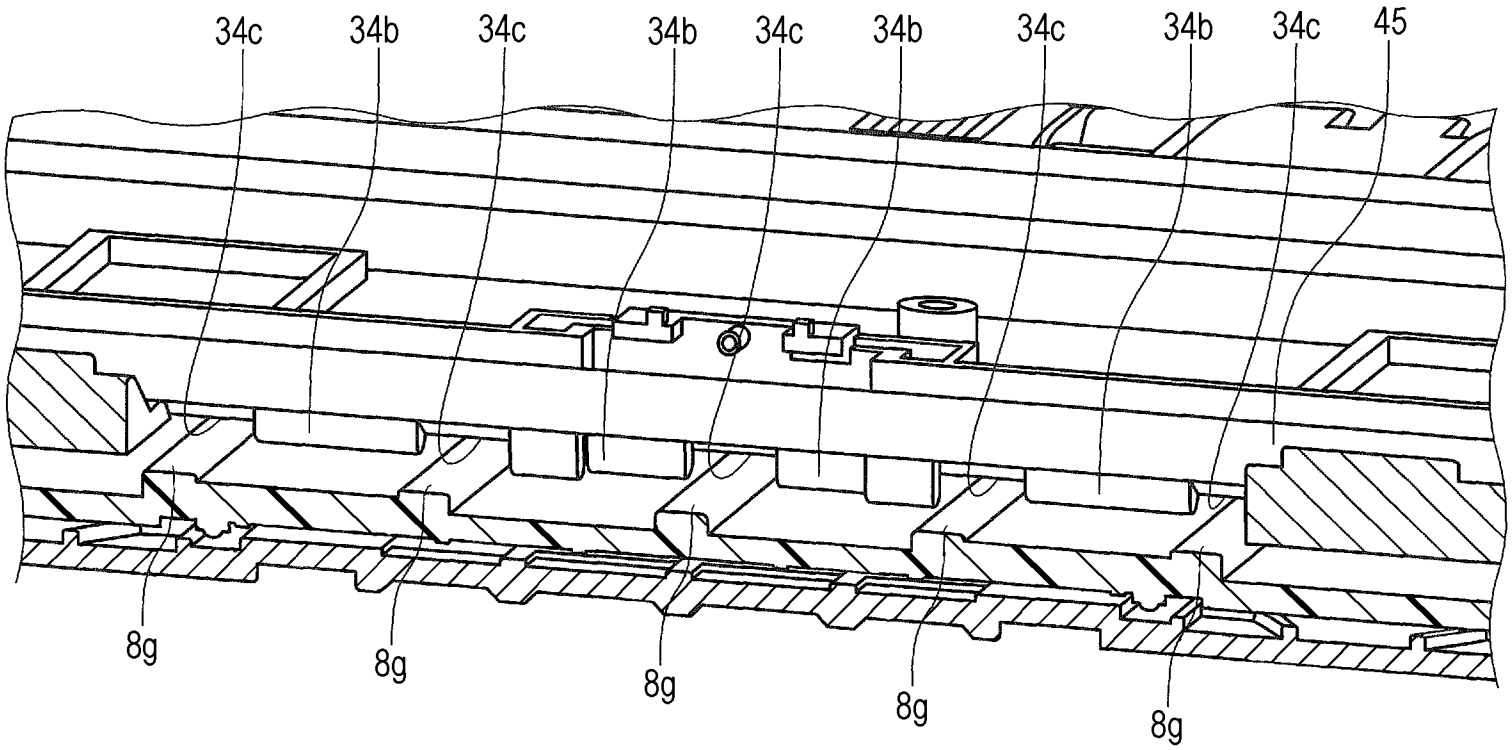
FIG. 9 is a cross-sectional perspective view illustrating a relationship between the frame configuring apparatus body and the discharged sheet reception tray.

FIGS. 1 to 3 are external perspective views of an ink jet printer (hereinafter, referred to as a "printer") 1 which is an embodiment of the "recording apparatus" according to the invention, FIGS. 4 to 6 are side cross-sectional views illustrating a sheet transportation path of the printer 1, FIG. 7 is a perspective view of a drive unit 42 driving a discharged sheet reception tray 8 and the discharged sheet reception tray 8, FIG. 8 is a perspective view illustrating a state where the discharged sheet reception tray 8 protrudes from a frame 34 configuring an apparatus body 2 of the printer 1, and FIG. 9 is a cross-sectional perspective view illustrating a relationship between the frame 34 and the discharged sheet reception tray 8.

Figure 10:
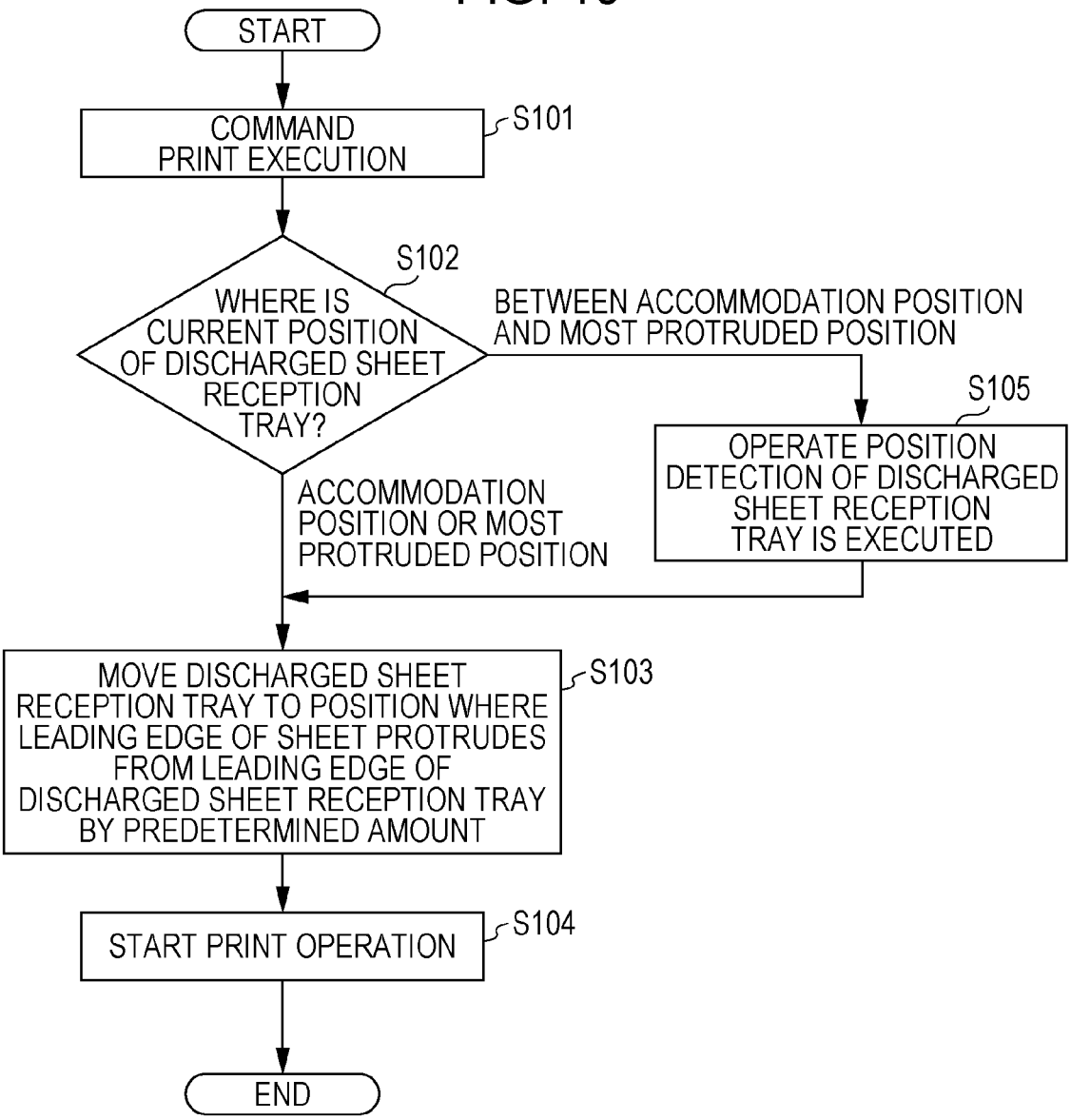
FIG. 10 is a flowchart illustrating a first embodiment of a position control of the discharged sheet reception tray, which is performed by a control unit.
Figure 11:
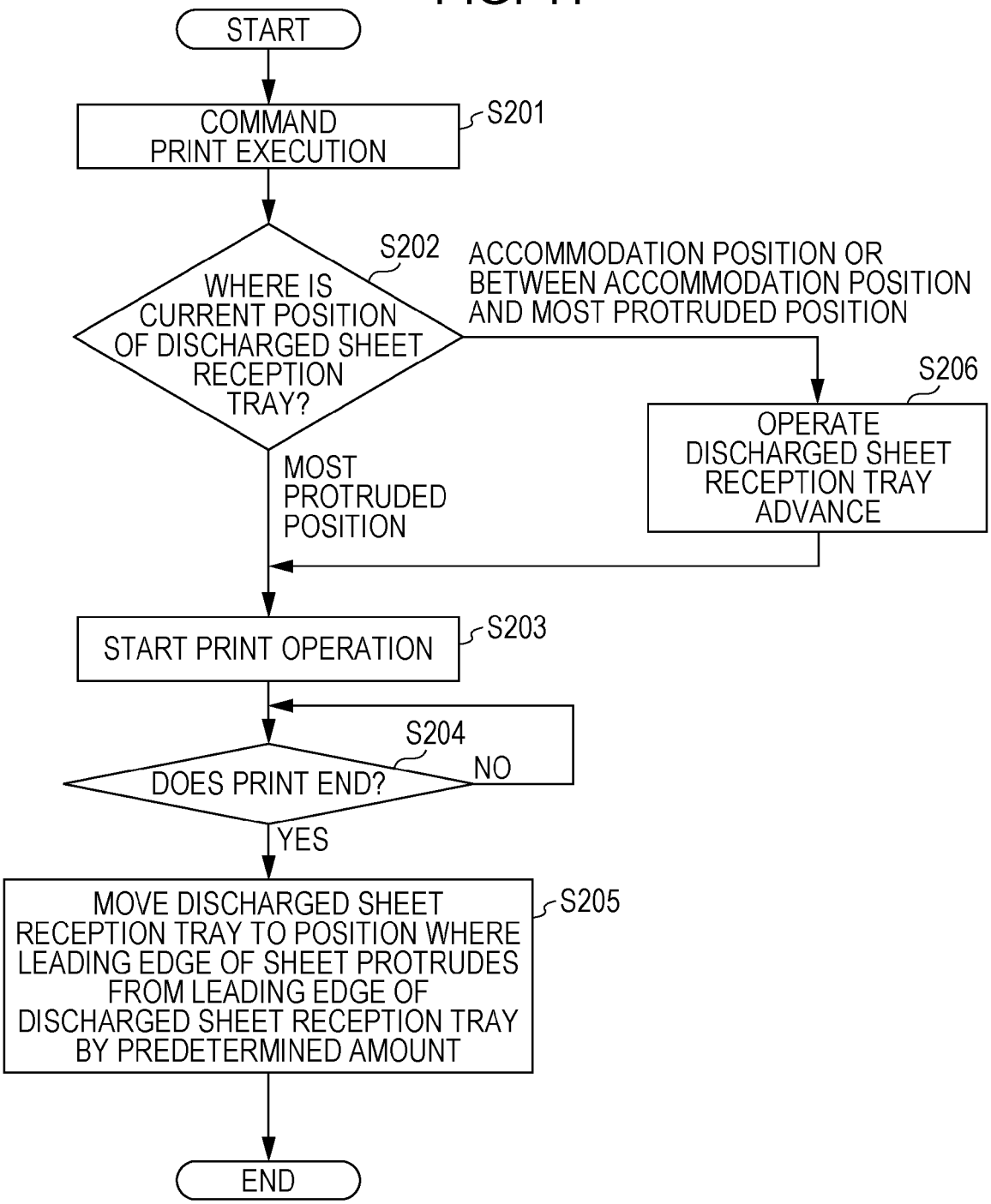
FIG. 11 is a flowchart illustrating a second embodiment of the position control of the discharged sheet reception tray, which is performed by the control unit.
Figure 12:
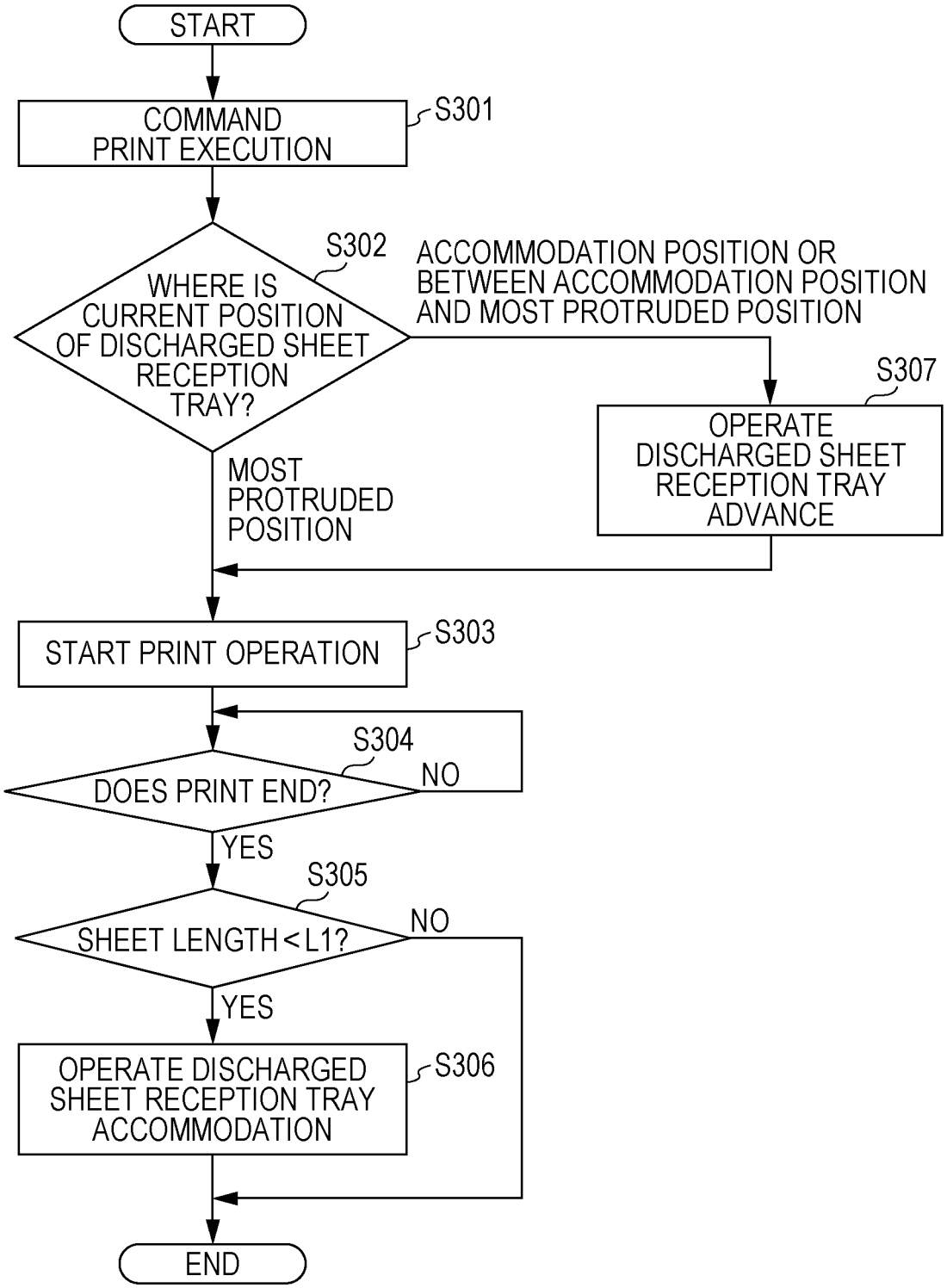
FIG. 12 is a flowchart illustrating a third embodiment of the position control of the discharged sheet reception tray, which is performed by the control unit.

In addition, FIG. 10 is a flowchart illustrating a first embodiment of a position control of the discharged sheet reception tray 8, which is performed by a control unit 40, FIG. 11 is a flowchart illustrating a second embodiment of the position control of the discharged sheet reception tray 8, which is performed by the control unit 40, and FIG. 12 is a flowchart illustrating a third embodiment of the position control of the discharged sheet reception tray 8, which is performed by the control unit 40.

Figure 13A:
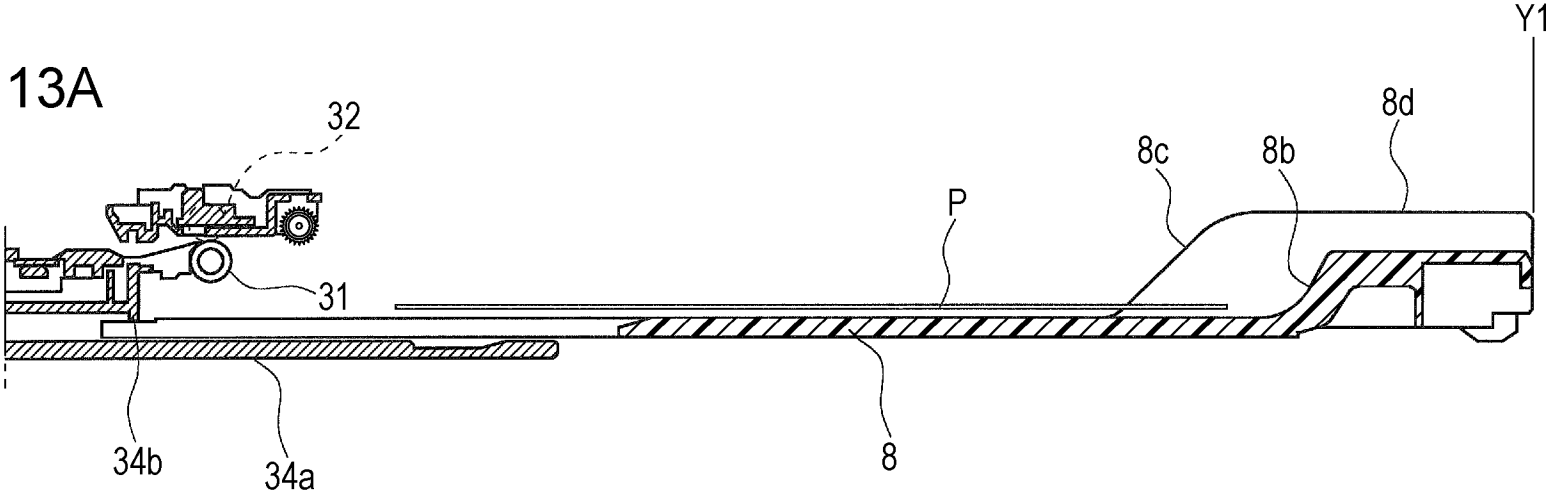
FIG. 13A is a diagram illustrating a state where a sheet is discharged when the discharged sheet reception tray is located at the most protruded position.
Figure 13B:
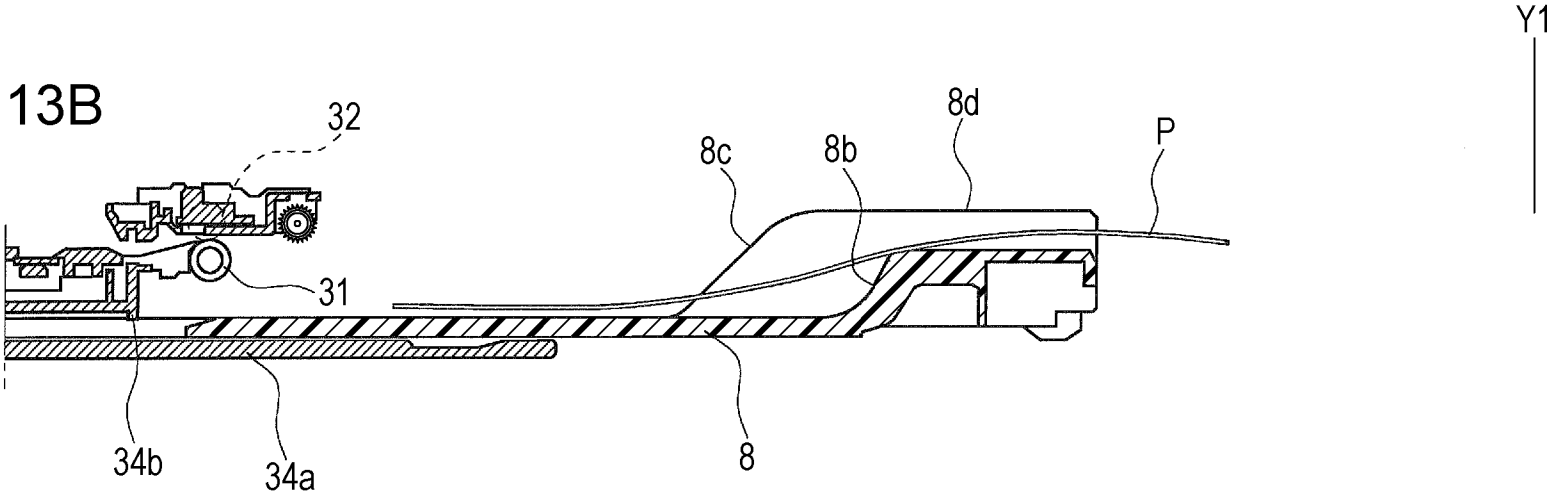
FIG. 13B is a diagram illustrating a state where the sheet is discharged when the discharged sheet reception tray is displaced depending on a sheet size.
Figure 14A:
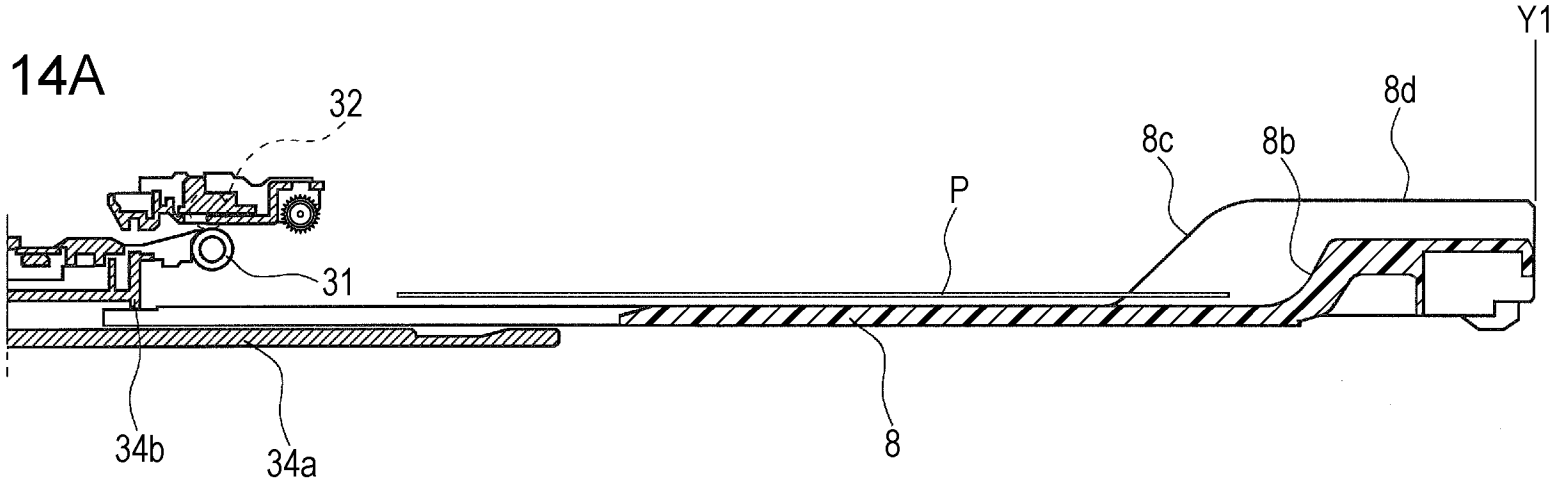
FIG. 14A is a diagram illustrating a state where the sheet is discharged where the discharged sheet reception tray is located at the most protruded position.
Figure 14B:
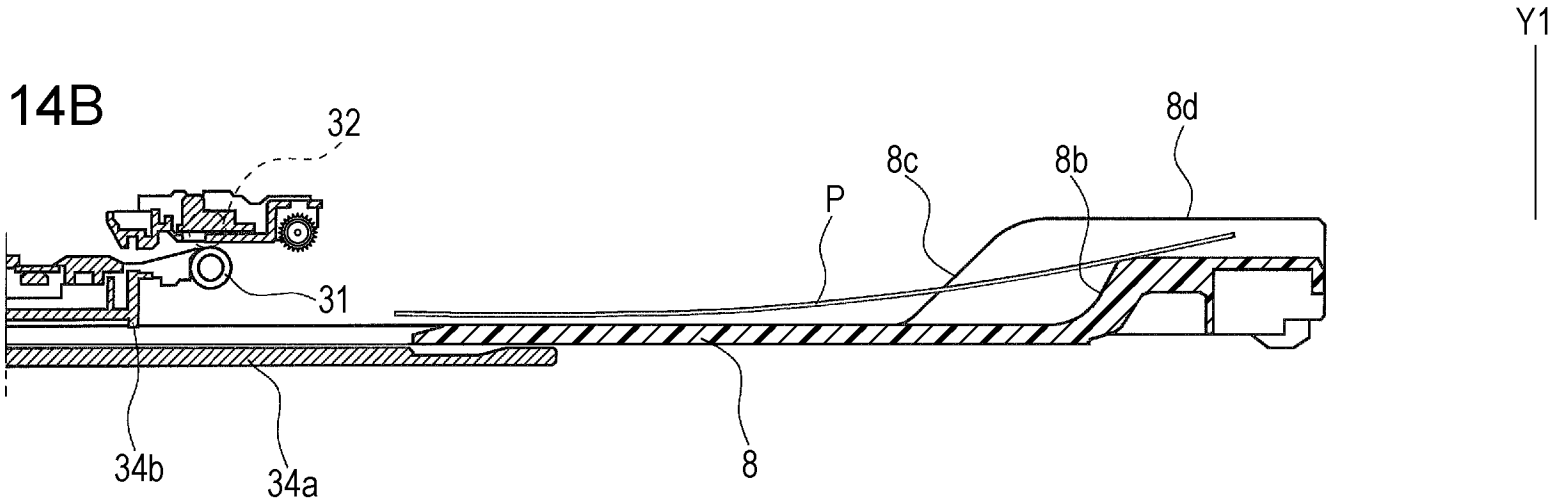
FIG. 14B is a diagram illustrating a state when the sheet is discharged when the discharged sheet reception tray is displaced depending on the sheet size.

In addition, FIG. 13A is a diagram illustrating a state where a sheet is discharged when the discharged sheet reception tray 8 is located at the most protruded position, and FIG. 13B is a diagram illustrating a state where the sheet is discharged when the discharged sheet reception tray 8 is displaced depending on a sheet size. FIG. 14A is a diagram illustrating the state where a sheet is discharged when the discharged sheet reception tray 8 is located at the most protruded position, and FIG. 14B is a diagram illustrating a state where the sheet is discharged when the discharged sheet reception tray 8 is displaced depending on the sheet size.

Figure 15A:
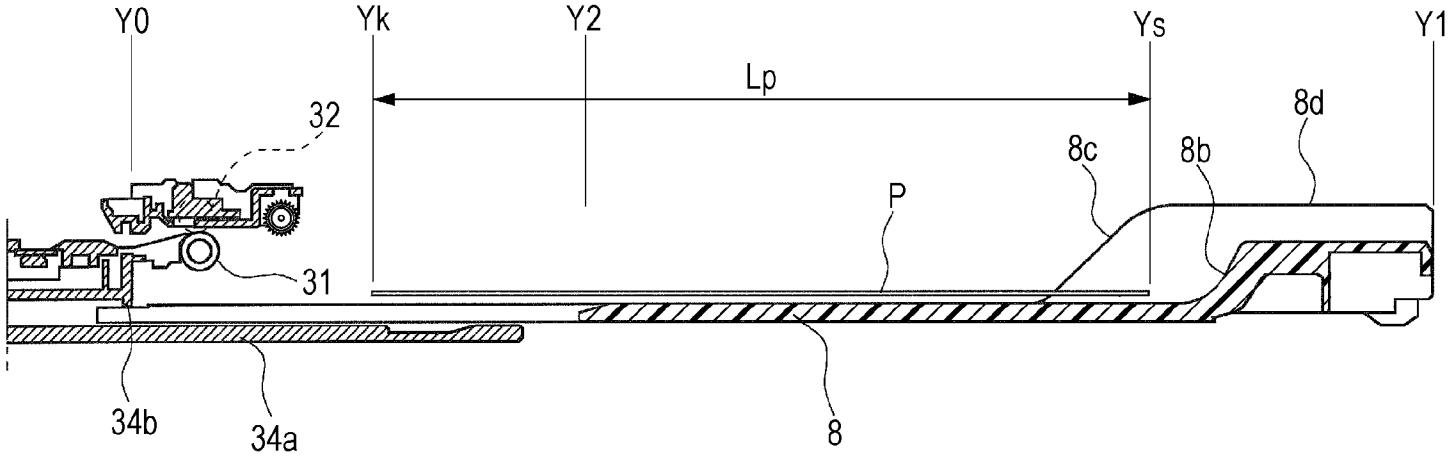
FIG. 15A is a diagram illustrating a state where the sheet is discharged when the discharged sheet reception tray is located at the most protruded position.
Figure 15B:
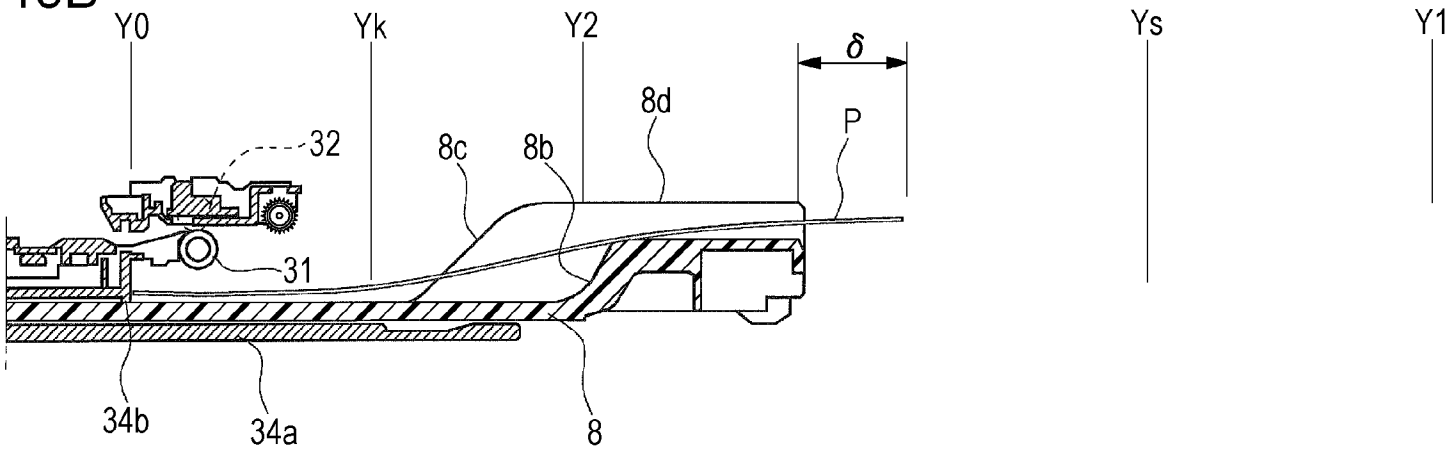
FIG. 15B is a diagram illustrating a state where the discharged sheet reception tray is displaced from the state of the FIG. 15A, depending on the sheet size.
Figure 16A:
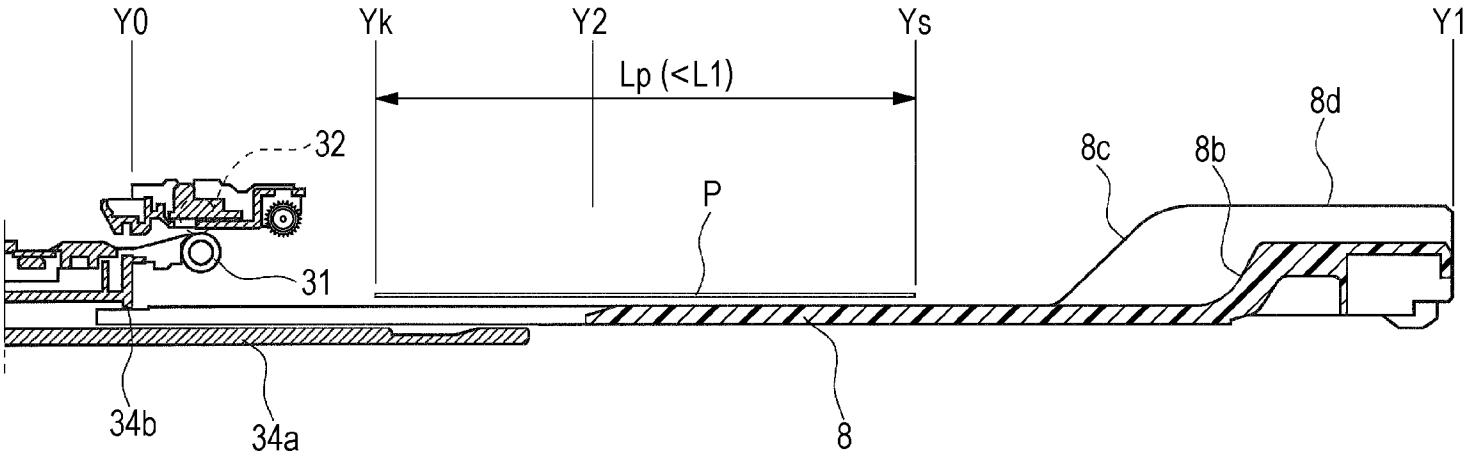
FIG. 16A is a diagram illustrating a state where the sheet is discharged when the discharged sheet reception tray is at the most protruded position.
Figure 16B:
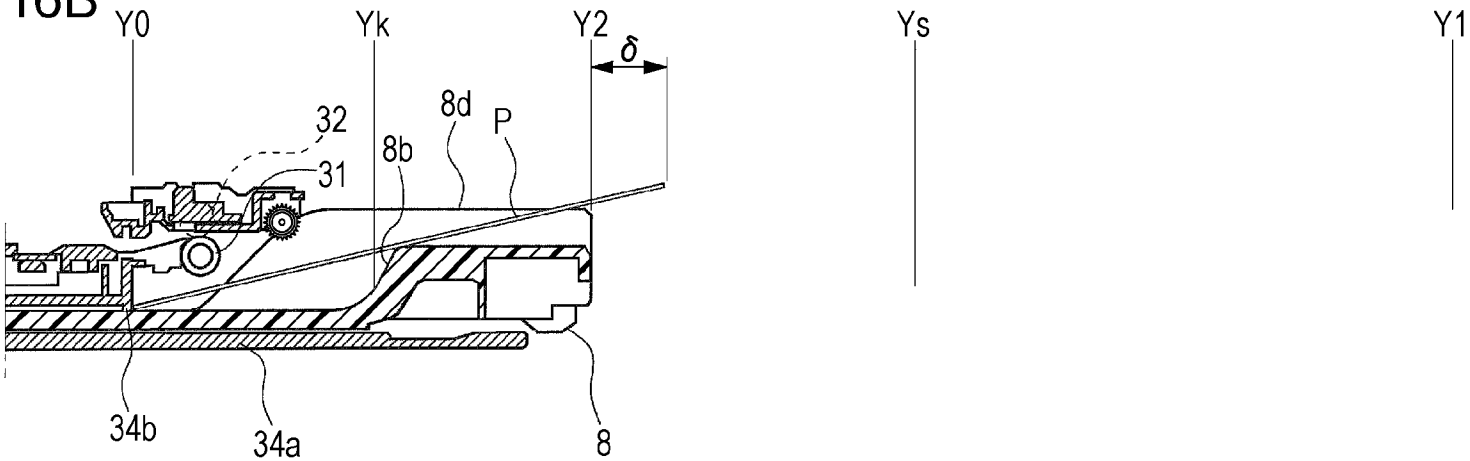
FIG. 16B is a diagram illustrating a state where the discharged sheet reception tray is displaced from the state of the FIG. 16A to an accommodation position.

FIG. 15A is a diagram illustrating a state where the sheet is discharged when the discharged sheet reception tray 8 is located at the most protruded position, and FIG. 15B is a diagram illustrating a state where the discharged sheet reception tray 8 is displaced from the state of the FIG. 15A, depending on the sheet size. FIG. 16A is a diagram illustrating a state where the sheet is discharged when the discharged sheet reception tray 8 is located at the most protruded position, and FIG. 16B is a diagram illustrating a state where the discharged sheet reception tray is displaced from the state of the FIG. 16A to the accommodation position.

Figure 17:
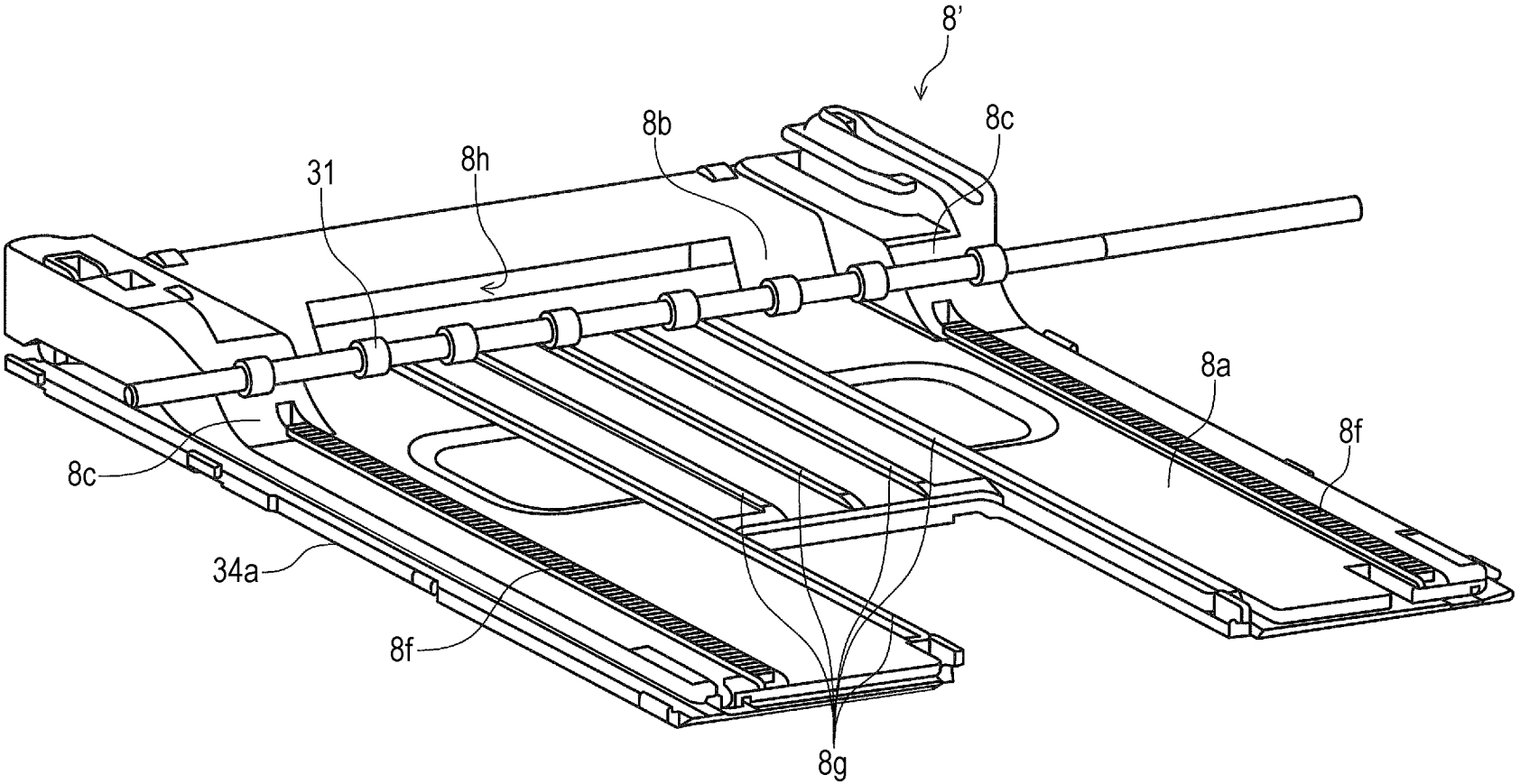
FIG. 17 is a perspective view illustrating the discharged sheet reception tray according to a second embodiment.
Figure 18:
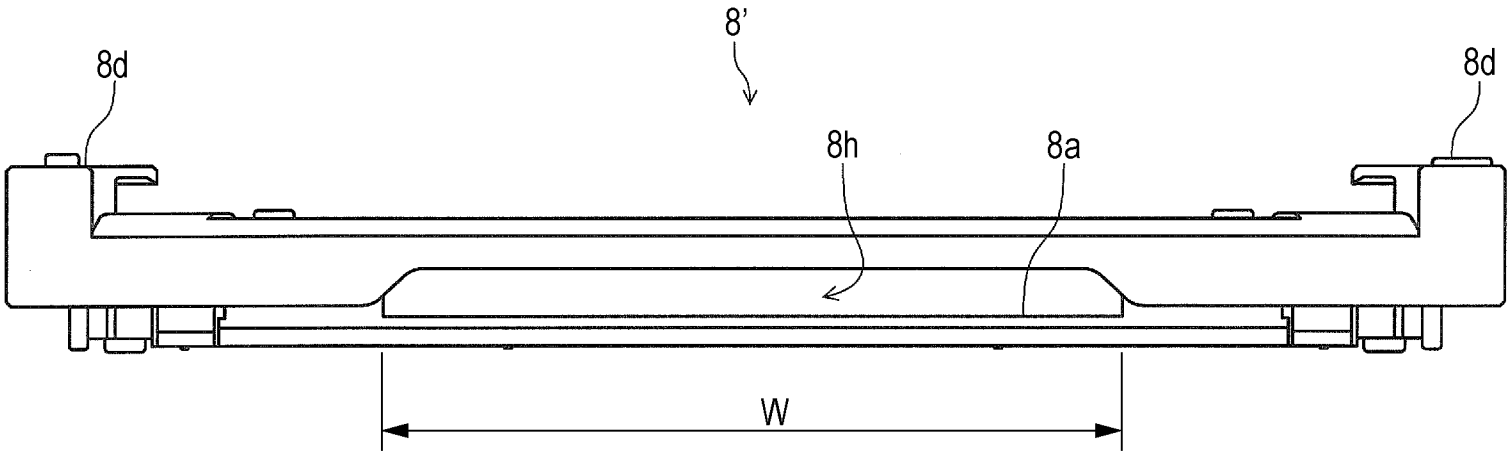
FIG. 18 is a front view illustrating the discharged sheet reception tray according to a second embodiment.
Figure 19A:
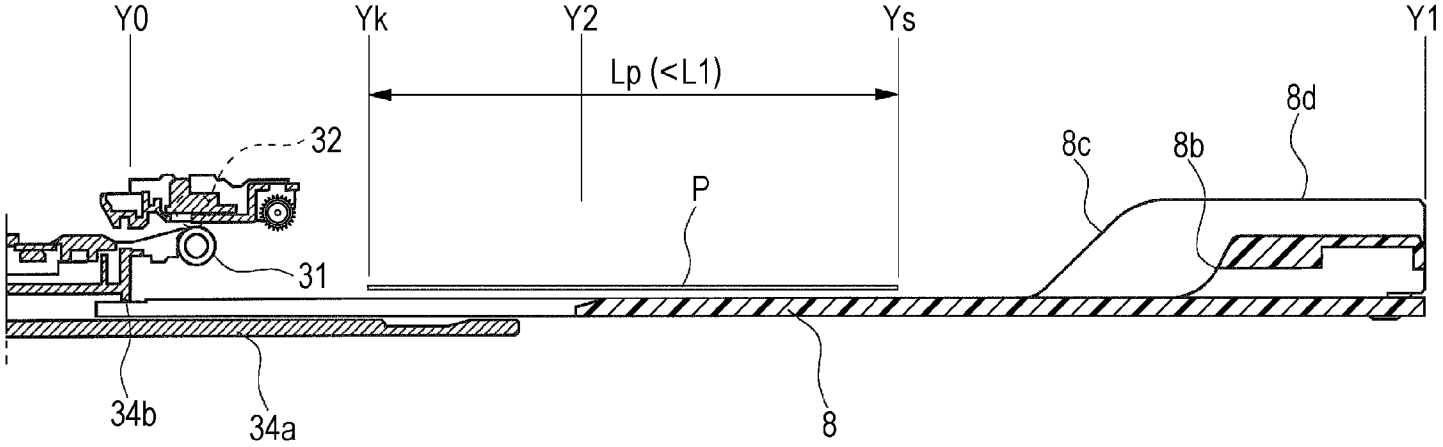
FIG. 19A is a diagram illustrating a state where a sheet is discharged in a state when the discharged sheet reception tray is at the most protruded position.
Figure 19B:
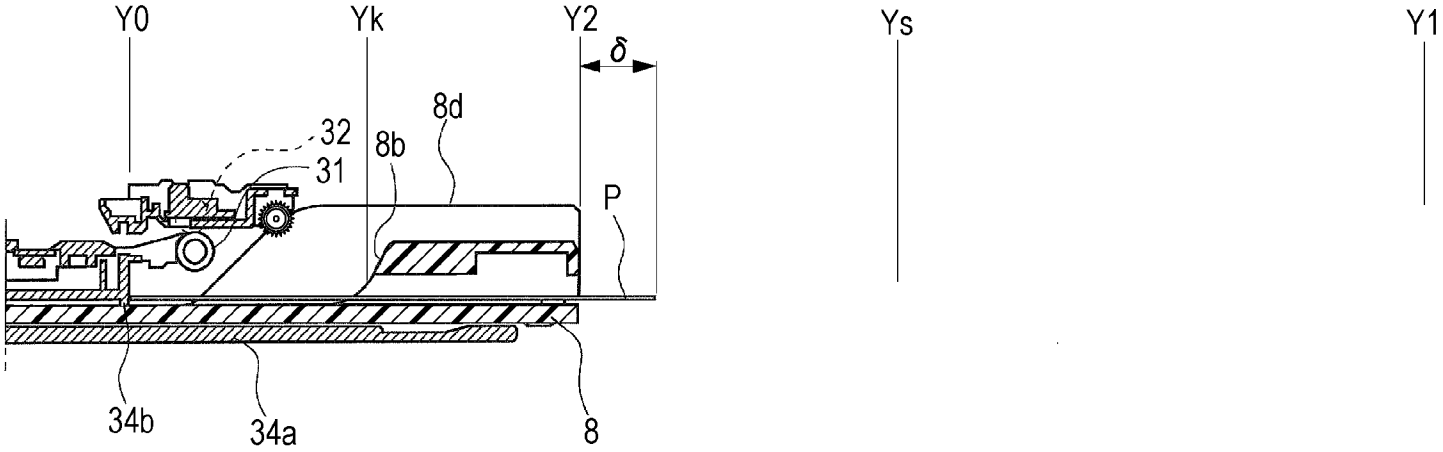
FIG. 19B is a diagram illustrating frame a state where the discharged sheet reception tray is displaced from the state of the FIG. 19A to the accommodation position.

Furthermore, FIG. 17 is a perspective view of a discharged sheet reception tray 8' according to a second embodiment, FIG. 18 is a front view of the same, FIG. 19A is a diagram illustrating a state where a sheet is discharged when the discharged sheet reception tray 8' is located at the most protruded position, and FIG. 19B is a diagram illustrating a state where the discharged sheet reception tray 8' is displaced from the state of the FIG. 19A to the accommodation position.

In addition, in each figure, the same reference numerals are given to the same configuration and position, and repeated description will be appropriately omitted.

1. Overall Configuration of Printer

Hereinafter, the overall configuration of the printer 1 will be described with reference to FIGS. 1 to 7. The printer 1 includes a scanner unit 3 (FIGS. 4 to 6) on the upper portion of an apparatus body 2 (recording unit) performing an ink jet recording on the recording sheet as an example of a medium, that is, the printer 1 is configured to be a complex apparatus having a scanner function in addition to ink jet recording function.

The scanner unit 3 is pivotably provided with respect to the apparatus body 2 and selects a closed state (FIG. 1) and an opened state (not illustrated) in a pivotal manner.

In the scanner unit 3, an upper cover 4 is a cover that can be opened and closed, and by opening the cover 4, a copy holder 3*a* (FIGS. 4 to 6) of the scanner unit 3 is made to be exposed.

In the front surface of the apparatus, a reference numeral 5 is an operation panel configured to include a power button, operational buttons which perform various printing set and recording executions, a display unit that performs a preview display of a printing setting content or a printing image, and the like. The operation panel 5 is configured to be able to tilt, and FIG. 1 illustrates a fully closed state, FIG. 2 is a fully opened state and FIG. 3 is a half opened state, respectively. The operation panel 5 as illustrated in FIGS. 1 to 3 is made to be adjustable at an angle which can be easily operated by user. Furthermore, an open angle of the operation panel 5 is held by an angle hold unit (not illustrated) and is made to hold its angle even in a case where an external force in a closing direction is applied to operate the button.

In the front surface of apparatus, a reference numeral 59 is a cover, provided in the lower stage tray 50, that can be opened and closed, and FIG. 1 illustrates a state where the cover 59 is closed, and FIGS. 2 and 3 illustrate a state where the cover 59 is opened, respectively. Then, by opening the cover 59, a lower stage tray 50, an upper stage tray 60 and the discharged sheet reception tray 8 can be exposed, and an attachment and detachment operation of the lower stage tray 50 and the upper stage tray 60 or a sliding operation of the discharged sheet reception tray 8 can be executed.

The discharged sheet reception tray 8 as a medium reception tray is slidably provided to be displaced between an accommodation position (second position: FIGS. 1, 2 and 4) which is accommodated in the apparatus body 2 by a drive unit 42 (FIG. 7) and the most protruded position (first position: FIGS. 3, 5 and 6) which most protrudes to the forward from the apparatus body 2. Then, by protruding the forward from the apparatus body 2, the recorded sheet on which the recording is performed and then is discharged can be received. Furthermore, though there is a case where the discharged sheet reception tray 8 receives the recorded sheet even at a protruded position (a position further drawn, by a predetermined amount, toward the accommodation position side than the most protruded position) except for the most protruded position, the explanation therefor will be described in detail later. In addition, the drive unit 42 will also be described in detail later.

The lower stage tray 50 and the upper stage tray 60 which is provided thereabove can accommodate a plurality of recording sheets, and are attachable or detachable to or from the apparatus body 2. Furthermore, in FIGS. 4 to 6, a reference numeral 34*a* is a partition plate which partitions accommodation regions of the lower stage tray 50 and the upper stage tray 60, and the accommodation region of the discharged sheet reception tray 8, and the partition plate 34*a* configures a part of the frame 34 configuring a base member of the apparatus body 2.

Subsequently, in a rear upper portion of the apparatus body 2, a reference numeral 6 is a manual bypass cover which can be opened and closed, and by opening the manual bypass cover 6, the recording sheet is able to be manually fed using a manual bypass tray 7 (FIGS. 4 to 6).

Subsequently, a sheet transportation path of the printer 1 will be described mainly with reference to FIGS. 4 to 6. The printer 1 according to the present embodiment includes the lower stage tray 50 and the upper stage tray 60 at the bottom of the apparatus and feeds the recording sheet one by one from the lower stage tray 50 or the upper stage tray 60.

The upper stage tray 60 is slidably provided to be displaced between a feedable position (FIG. 6) and a retracted position (FIGS. 4 and 5), and is configured to be displaced between the feedable position (FIG. 6) and the retracted position (FIGS. 4 and 5) by receiving a power from a motor (not illustrated).

Furthermore, in the FIGS. 4 to 6, the sheet accommodated in the lower stage tray 50 is denoted by a reference numeral P1, and the sheet accommodated in the upper stage tray 60 is denoted by a reference numeral P2, respectively (hereinafter, referred to as a "sheet P" in a case where there is no need to particularly distinguish them). In addition, a crossing trajectory of the sheet P1 fed from the lower stage tray 50 is denoted by a dashed line T1, and the crossing trajectory of the sheet P2 fed from the upper stage tray 60 is denoted by a dashed line T2.

A feed roller (also referred to as a pick-up roller) 10 rotatably driven by a motor (not illustrated) is provided in an oscillation member 11 oscillating about a pivot shaft 12, and feeds the uppermost sheet P1 from the lower stage tray 50 by rotating while coming into contact with the uppermost sheet of the sheets P1 which are accommodated in the lower stage tray 50 in a state where the upper stage tray 60 is slid to the most forward side (to the right direction in FIGS. 4 to 6: a direction where the upper stage tray 60 is drawn out of the apparatus), that is, when the upper stage tray 60 is located at the retracted position (state in FIGS. 4 and 5).

In addition, when the upper stage tray 60 is located at a position where the upper stage tray 60 is slid and abuts against the most rear side (the left direction in FIGS. 4 to 6: the mounting direction side of the upper stage tray 60, that is, the sheet feed direction) of the apparatus, that is, at a feedable position (state in FIG. 6) of the upper stage tray 60, by rotating the feed roller 10 is rotated while coming into contact with the uppermost sheet P2 accommodated in the upper stage tray 60, and thereby the uppermost sheet P2 is fed from the upper stage tray 60.

Furthermore, in the present embodiment, the pivot shaft 12 configures the oscillate shaft of the oscillation member 11, and by rotating using a power from a motor (not illustrated), the power is transmitted from the pivot shaft 12 via a gear train wheel (not illustrated) to the feed roller 10. In addition, in the present embodiment, the oscillation member 11 and the feed roller 10 configure a feed unit 9 which feeds the sheet P.

Subsequently, in the apparatus body 2, a separation inclined surface 16 is provided at a position opposing leading edges of the lower stage tray 50 and the upper stage tray 60, and the sheet P fed from the lower stage tray 50 or the upper stage tray 60 proceeds to the downstream side while leading edge comes into contact with the separation inclined surface 16 and therefore, the uppermost sheet P to be fed and the next uppermost sheet P is separated.

An intermediate roller 17 which is rotatably driven by a motor (not illustrated), is provided in the front of a separation unit 14, and the sheet P is curved and reversed by the intermediate roller 17 to be headed toward the front side of the apparatus. Furthermore, reference numerals 19, 20 and 21 are driven rollers which are rotatably driven, and at least the sheet P is nipped by the driven roller 19 and the intermediate roller 17 or is nipped by the driven roller 20 and the intermediate roller 17 to be fed to the downstream side.

A transportation drive roller 24 which is rotatably driven by a motor (not illustrated) and a transportation driven roller 25 which is rotatably driven in coming into contact with the transportation drive roller 24 are provided in front of the intermediate roller 17, and the sheet P is fed downward from a recording head 30 by the rollers.

Subsequently, the recording head 30 ejecting the ink is provided at the bottom of a carriage 29, and the carriage 29 is driven to reciprocate in a main scan direction (forward and backward direction from the paper surface in FIGS. 4 to 6) by the motor (not illustrated).

A support member 28 is provided at a position opposing the recording head 30, and a gap between the sheet P and the recording head 30 is defined by the support member 28. Then, downstream of the support member 28, a discharge unit including a discharge drive roller 31 which is rotatably driven by a motor (not illustrated) and a discharge driven roller 32 which is rotatably driven while being in contact with the discharge drive roller 31 is provided. The sheet P on which the recording is performed by the recording head 30 is discharged toward the discharged sheet reception tray 8 as described above.

2. Details on Discharged Sheet Reception Tray 8

The above description is the overall configuration of the printer 1, and hereinafter, the discharged sheet reception tray 8 as the medium reception tray will be described in more detail.

In the present embodiment, the discharged sheet reception tray 8 in FIG. 7 is configured such that the entire region of a sheet reception surface 8*a* receiving the sheet is formed of one member, that is, is configured to have a single stage type of tray, not a multi-stage type (drawing out type). More specifically, in the present embodiment, the overall of the discharged sheet reception tray 8 is integrally formed of a resin material. Thereby, the overall rigidity is improved as the discharged sheet reception tray 8 and thus a simplified structure enables a low manufacturing cost.

The discharged sheet reception tray 8 is configured such that its side end portions (end portions in a direction (sheet width direction) intersecting with the sheet discharge direction) 8*e* are slidably supported with respect to a frame 34 (FIG. 8) configuring a base body of the apparatus body 2. Rack units 8*f* are formed, along the sheet discharge direction, at both end portions (both end portions in the direction intersecting with the sheet discharge direction) of the discharged sheet reception tray 8.

The rack units 8*f* configure a rack and pinion mechanism, and are engaged with pinion gears 44 configuring a drive unit 42. Two pinion gears 44 are provided with a predetermined space in an axial direction of a rotation shaft 45, and the rotation shaft 45 receives the power of a motor 43 via a gear train wheel 46 configuring the drive unit 42, and accordingly the discharged sheet reception tray 8 is configured to perform a displacement (slide) operation by the rotation shaft 45. Furthermore, in the present embodiment, the rack units 8*f* are formed at both end portions, but may be formed at only one end side.

The rotation shaft 45 configuring the drive unit 42 is controlled by the control unit 40, and therefore the discharged sheet reception tray 8 is displaced between the accommodation position (second position: FIGS. 1, 2 and 4) and the most protruded position (first position: FIGS. 3, 5 and 6) based on the control of the control unit 40. In addition, it is possible that the control unit 40 apprehends which position the discharged sheet reception tray 8 is currently located, based on a signal received from a tray position detection unit 41.

Furthermore, the tray position detection unit 41 according to the present embodiment returns to the control unit 40 the signal indicating any one of three states, as to whether the discharged sheet reception tray 8 is located at the most protruded position, at the accommodation position or at neither position. The tray position detection unit 41 may be either a contact type sensor which comes into contact with the discharged sheet reception tray 8 or a non-contact type sensor, such as an optical type, which does not come into contact with the discharged sheet reception tray 8. In addition, the tray position detection unit 41 may be configured to have a rotary encoder which detects a rotation amount of the rotation shaft 45 or may be a combination of the contact type or non-contact type position sensor and the above described rotary encoder. The control unit 40 can adjust the position of the discharged sheet reception tray 8 between the accommodation position and the most protruded position, based on position detection information of the discharged sheet reception tray 8 the rotation direction of the rotation shaft 45 and the rotation amount using the tray position detection unit 41.

Subsequently, in the discharged sheet reception tray 8, ridge-like units 8*d* over which both end portions of the sheet ride (both end portions in the direction (width direction of the sheet) intersecting with the sheet discharge direction) are respectively formed at both sides in downstream of the sheet reception surface 8*a*. With regard to the sheet having a size which causes both end portions to ride over the ridge-like units 8*d*, the leading edge of the sheet rides over whereby preventing the sheet from falling down from the discharged sheet reception tray 8. Furthermore, the riding-over of both end portions of the sheet enables a curl to be formed on the sheet. Thereby, it is possible to prevent the leading edge of the sheet from escaping out of the tip of the discharged sheet reception tray 8 and falling down. Furthermore, inclined guide surfaces 8*c* are formed upstream of the ridge-like units 8*d*, and thereby the leading edge of the sheet smoothly rides over the ridge-like units 8*d* without being caught.

On the other hand, with regard to the sheet having the width which does not cause both end portions to ride over the ridge-like portion 8*d*, in most cases, the leading edge of the sheet does not protrude from the leading edge of the discharged sheet reception tray 8 and therefore, there is no possibility that the sheet may not fall from the discharged sheet reception tray 8. Moreover, inclined guide surfaces 8*b* are formed downstream of a central region of the sheet reception surface 8*a*, and therefore, with regard to the sheet having the width which does not cause both end portions to ride over the ridge-like units 8*d*, the inclined guide surface 8*b* prevents the sheet from falling down from the discharged sheet reception tray 8.

Next, a regulation unit which regulates the drawing of the sheet discharged to the discharged sheet reception tray 8 will be described referring to FIGS. 8 and 9. In order that the discharged sheet reception tray 8 as described above performs a forward and backward operation using a power of the motor 43, for example, if the sheet remains placed on the tray when being displaced from the most protruded position to the accommodation position, there is a possibility that the sheet and the discharged sheet reception tray 8 may be drawn into the apparatus to result in the jam. Therefore, the present embodiment includes the regulation unit which regulates the drawing of the sheet by being engaged with the trailing edge of the sheet when the discharged sheet reception tray 8 is displaced in the direction from the most protruded position toward the accommodation position.

The regulation unit is configured to have tray side ribs 8*g* formed along the sheet discharge direction in the discharged sheet reception tray 8, and concave grooves 34*c* which are formed in the frame 34 configuring the tray accommodation unit where the discharged sheet reception tray 8 is accommodated, and which the tray side ribs 8*g* enter (FIG. 9). That is, the tray side ribs 8*g* are formed to protrude from the sheet reception surface 8*a*, and then are provided in a plurality of numbers with an appropriate gap in the sheet width direction.

The concave grooves 34*c* are provided corresponding to the tray side ribs 8*g* in the frame 34, and the plurality of tray side ribs 8*g* and the plurality of concave grooves 34*c* are alternately fitted to form a comb-like structure. Furthermore, the reference numeral 34*b* indicates a convex portion fitted between two tray side ribs 8*g*.

Using such a comb-like structure, even if the discharged sheet reception tray 8 is drawn into the frame 34 while the sheet remains placed on the discharged sheet reception tray 8, the trailing edge on the discharged sheet reception tray 8 comes into contact with the comb-like structure (specifically, convex portion 34*b*), and thereby the drawing into the frame 34 is regulated.

First Embodiment of Discharged Sheet Reception Tray Position Control

Subsequently, the control of the discharged sheet reception tray 8 by the control unit 40 will be described with reference to FIG. 10. In FIG. 10, if the control unit 40 receives a printing execution command (step S101), the current position of the discharged sheet reception tray 8 is determined (step S102), if it is determined as either the accommodation position or the most protruded position, the discharged sheet reception tray 8 is moved to the position where the leading edge of the sheet protrudes by a predetermined amount from leading edge of the discharged sheet reception tray 8, based on size information of the sheet (step S103), and then a printing operation is started (step S104).

Thereby, as illustrated in FIG. 13B, the leading edge of the sheet protrudes by the predetermined amount from the leading edge of the discharged sheet reception tray 8 and accordingly the sheet is easily taken out. Furthermore, FIG. 13A for comparing purpose illustrates a state of the sheet in a case where the sheet is discharged while holding the discharged sheet reception tray 8 at the most protruded position. As is apparent from the comparison between FIGS. 13A and 13B, it is easy to take the sheet in a state where the leading edge of the sheet protrudes by a predetermined amount from the leading edge of the discharged sheet reception tray 8 (it is possible to easily pick up the leading edge of the sheet). Furthermore, in FIGS. 13A and 13B, a position Y1 is a tip position of the discharged sheet reception tray 8 when the discharged sheet reception tray 8 is located at the most protruded position.

Furthermore, as a result of determining the current position of the discharged sheet reception tray 8, if the discharged sheet reception tray 8 is located neither at the accommodation position nor the most protruded position, the position detection operation of the discharged sheet reception tray 8 is performed (step S105). The position detection operation is an operation detecting that for example, the discharged sheet reception tray 8 is located at the accommodation position using the tray position detection unit 41 by rotating the motor 43 in a direction where the discharged sheet reception tray 8 is displaced to the accommodation position. Furthermore, such a position detection operation may be configured such that the discharged sheet reception tray 8 is located the most protruded position by rotating the motor 43 in a direction where the discharged sheet reception tray 8 is displaced to the most protruded position, and then is detected using the tray position detection unit 41.

In the present embodiment, the control unit 40 causes the discharged sheet reception tray 8 to be displaced to the position where the leading edge of the sheet protrudes by a predetermined amount from the leading edge of the discharged sheet reception tray 8, based on the received size information of the sheet, but in a case where a feeding ability of the sheet is considered, it is not necessarily to configure such that the leading edge of the sheet is caused to protrude from the leading edge of the discharged sheet reception tray 8. For example, in the present embodiment, the inclined guide surface 8*b* and the inclined guide surface 8*c* are formed at the leading edge of the tray. Therefore, even though the leading edge of the sheet does not protrude from the leading edge of the discharged sheet reception tray 8, if the leading edge of the sheet rides over the inclined guide surfaces 8*b* and 8*c*, and a predetermined gap is formed between the leading edge of the sheet and the discharged sheet reception tray 8, a finger can be inserted into the gap and thus the sheet can be is easily taken. FIG. 14B illustrates such a state. Furthermore, FIG. 14A illustrates a state of the sheet in a case where the sheet is discharged while holding the discharged sheet reception tray 8 at the most protruded position, for comparing purpose in similar to FIG. 13A.

As described above, according to the present embodiment, the control unit 40 controlling the position of the discharged sheet reception tray 8 switches the position of the discharged sheet reception tray 8 depending on the length of the sheet to be discharged and therefore, taking the sheet from the discharged sheet reception tray 8 is easily improved. In the present embodiment, specifically, the discharged sheet reception tray 8 (the drive unit 42) is controlled such that the leading edge of the discharged sheet protrudes by a predetermined amount from the discharged sheet reception tray 8. Therefore, the sheet can be easily taken from the discharged sheet reception tray 8 by picking up the leading edge of the sheet.

Second Embodiment of Discharged Sheet Reception Tray Position Control

Next, the second embodiment of a position control of the discharged sheet reception tray 8 will be described with reference to 11. In the embodiment, the control unit 40 receives the printing execution command (step S201), determines the current position of the discharged sheet reception tray 8 (step S202), if the discharged sheet reception tray 8 is located at the most protruded position, and starts the printing operation (step S203). Thereby, the sheet is discharged in a state where the discharged sheet reception tray 8 protrudes as much as possible. Therefore, the discharged sheet does not fall down from the discharged sheet reception tray 8 and thus it is possible to reliably receive the sheet. The state at this time is illustrated in FIG. 15A.

In a case where the printing operation is completed (more specifically, the sheet discharge operation is completed) (Yes in step S204), based on size information of the sheet, the discharged sheet reception tray 8 is moved to the position where the leading edge of the sheet protrudes by a predetermined amount from the leading edge of the discharged sheet reception tray 8 (step S205). Thereby, as illustrated in FIGS. 15A and 15B, the leading edge of the sheet protrudes by a predetermined amount (6) from the leading edge of the discharged sheet reception tray 8, and thus it becomes easy to take out the sheet.

Here, in FIGS. 15A and 15B, a position Y0 is a position of the convex portion 34*b* (FIG. 9) configuring the comb-like structure described above, that is, a position where the leading edge of the sheet comes into contact with the frame 34 when the discharged sheet reception tray 8 is displaced to the accommodation position while the sheet remains placed on the discharged sheet reception tray 8. In addition, a position Yk is a position of the trailing edge of the discharged sheet, the position Yk is changed depending on the rotation speed of the discharge drive roller 31, a material of the sheet, a size of the sheet or the like, and can be experimentally pre-obtained using the sheet intended to be used. In addition, a position Ys is a position of the leading edge of the sheet, and is a position changed depending on a sheet length Lp. In addition, a position Y2 is a position of the leading edge of the discharged sheet reception tray 8 when is located at the accommodation position.

After the sheet is discharged to the discharged sheet reception tray 8, if the discharged sheet reception tray 8 is displaced toward the accommodation position, the sheet is drawn together with the discharged sheet reception tray 8 until the trailing edge of the sheet comes into contact with the convex portion 34*b* of the frame 34. The displacement amount of the discharged sheet reception tray 8 until the trailing edge of the sheet comes into contact with the convex portion 34*b* of the frame 34 is Yk−Y0. If the trailing edge of the sheet comes into contact with the convex portion 34*b* of the frame 34, thereafter, the sheet is not drawn and only the discharged sheet reception tray 8 is drawn. Substantially, when displaced by Y1−Ys, the position of the leading edge of the sheet coincides with the position of the leading edge of the discharged sheet reception tray 8. Furthermore, from such a state, if the discharged sheet reception tray 8 is drawn by δ, the leading edge of the sheet protrudes by δ from the leading edge of the discharged sheet reception tray 8.

Referring back to FIG. 11, in step S202, in a case where the discharged sheet reception tray 8 is not present at the most protruded position, the discharged sheet reception tray 8 is switched to the most protruded position by rotating the motor 43 in the direction where the discharged sheet reception tray 8 is displaced (step S206). The steps thereafter are the same as steps after step S203 described above.

As described above, according to the present embodiment, the control unit 40 controlling the position of the discharged sheet reception tray 8 causes the discharged sheet reception tray 8 to be held at the most protruded position until the sheet discharge operation is completed at least by the discharge drive roller 31 and the discharge driven roller 32. Therefore, it is possible to prevent the discharged sheet from falling down from the discharged sheet reception tray 8, that is, it is possible to reliably receive the sheet. Then after the discharge operation is completed, the position of the discharged sheet reception tray 8 is switched depending on the length of the sheet to be discharged, and therefore, it is possible to easily take the sheet from the discharged sheet reception tray 8.

Third Embodiment of Position Control of Discharged Sheet Reception Tray

Next, the third embodiment of the control of the discharged sheet reception tray 8 will be described with reference to FIG. 12. In the embodiment, the control unit 40 receives the printing execution command (step S301), the current position of the discharged sheet reception tray 8 is determined (step S302), and starts printing drive if the discharged sheet reception tray 8 is located at the most protruded position (step S303). Thereby, the sheet is discharged in a state where the discharged sheet reception tray 8 protrudes as much as possible as illustrated in FIG. 16A. Therefore, the discharged sheet does not fall down from the discharged sheet reception tray 8, and thus it is possible to reliably receive the sheet.

In a case where the printing operation is completed (more specifically, the sheet discharge operation is completed) (Yes in step S304), based on the size information of the sheet, it is determined whether or not the length of the sheet is less than L1 (step S305), and if the length of the sheet is less than L1 (Yes in step S305), the discharged sheet reception tray 8 is switched to the accommodation position (step S306). Here, in a case where the length of the sheet is less than L1, when the discharged sheet reception tray 8 is switched to the accommodation position, as an example, the length of the sheet is configured such that the leading edge of the sheet is a length such that the leading edge of the sheet does not protrude from the leading edge of the discharged sheet reception tray 8 exceeding one third of the entire length of the sheet (δ does not exceed [Lp/3] in FIGS. 16A and 16B), that is, the sheet has the length such that the sheet does not fall down from the discharged sheet reception tray 8 even when the discharged sheet reception tray 8 is switched to the accommodation position. However, L1 is not limited to [Lp/3], and the value may be appropriately adjusted.

In this manner, the leading edge of the sheets protrudes by a predetermined amount from the leading edge of the discharged sheet reception tray 8 (FIG. 16B), and thus the it is easy to take out the sheet. In addition, based on the length of the sheet, a simple control may be simplified as to whether the discharged sheet reception tray 8 is held at the most protruded position or as to whether it is switched to the accommodation position. Therefore, the control becomes easy using the control unit 40.

Furthermore, in step S302, in a case where the discharged sheet reception tray 8 is not present at the accommodation position or the most protruded position, the discharged sheet reception tray 8 is switched to the most protruded position by rotating the motor 43 in the direction where the discharged sheet reception tray 8 is displaced to the most protruded position (step S307). Steps thereafter are the same as steps after step S303 described above.

As described above, according to the present embodiment, the control unit 40 which controls the position of the discharged sheet reception tray 8 causes the discharged sheet reception tray 8 to be held at the most protruded position until the sheet discharged detection operation is completed at least by the discharge drive roller 31 and the discharge driven roller 32. Therefore, it is possible to prevent the discharged sheet from falling down from the discharged sheet reception tray 8, that is, it is possible to reliably receive the sheet.

Then, after the discharge operation is completed, since the discharged sheet reception tray 8 is switched to the accommodation position, thereby, the leading edge of the sheet protrudes from the leading edge of the discharged sheet reception tray 8, and therefore, it is possible to easily take the sheet from the discharged sheet reception tray 8. In addition, at this time, in a case where the length of the sheet is shorter than a predetermined length, since the discharged sheet reception tray 8 is held at the most protruded position without switching the discharged sheet reception tray 8 to the accommodation position. Therefore, in a case where the length of the sheet is long, it is possible to prevent the discharged sheet reception tray 8 from falling down from the discharged sheet reception tray 8 when the discharged sheet reception tray 8 is switched to the accommodation position.

Another Embodiment of Discharged Sheet Reception Tray

Subsequently, another embodiment of the discharged sheet reception tray will be described with reference to FIGS. 17 to 19B. In a discharged sheet reception tray 8' illustrated in FIGS. 17 to 19B, an opening portion 8*h* is formed on the inclined guide surface 8*b*. The opening portion 8*h* is formed with a width W in the substantially center in the width direction of the discharged sheet reception tray 8', and in a case where width of the discharged sheet is smaller than W, the leading edge of the sheet does not ride over the inclined guide surfaces 8*b* and 8*c*, and the sheet is discharged in a linear fashion as it is from the opening portion 8*h*.

The control of the control unit 40 in a case employing such a discharged sheet reception tray 8' can use the third embodiment described above, for example. That is, until the sheet discharge operation is completed, the discharged sheet reception tray 8' is held at the most protruded position (FIG. 19A), and after the sheet discharge operation is completed, the discharged sheet reception tray 8' is switched to the accommodation position depending on the sheet size (in a case where the sheet size is shorter than the predetermined size) (FIG. 19B). Thereby, the leading edge of the sheet protrudes from the leading edge of the discharged sheet reception tray 8', and it becomes easy to take the sheet.

Furthermore, in a case where the sheet size is shorter than the predetermined size, the discharged sheet reception tray 8' may be switched in advance to the accommodation position before starting the print (before discharging the sheet).

According to the present embodiment described above, in a case where the sheet has the width less than the predetermined width, the leading edge is configured to enter the opening portion 8*h*, and thereby the sheet is discharged substantially in a linear fashion until the sheet discharge operation is completed. Accordingly, when performing the recording on a small size sheet having a high rigidity tendency such as a post card or a business card, the sheet posture is not bent, but held substantially in the linear fashion. Therefore, it is possible to obtain a good recording result by preventing occurrence of the back-tension (transportation load).

In addition, in a case of small size sheet is small, for example, since the sheet can be discharged while holding the discharged sheet reception tray 8' at the accommodation position, it is not necessary to switch the discharged sheet reception tray 8' to the most protruded position in advance. Therefore, a throughput can be improved.

Embodiments of the invention relate to a method of controlling a recording apparatus which includes a recording unit that performs recording on a medium, a discharge unit that discharges the medium on which the recording is performed by the recording unit, a medium reception tray that is provided to be capable of displacing between a first position protruding in a medium discharge direction and a second position drawn in an opposite direction to the medium discharge direction and receives the medium discharged by the discharge unit, a drive unit that drives the medium reception tray, and a control unit that controls the drive unit. The method may include receiving a recording execution command, determining a current position of the medium reception tray, starting a recording operation by switching the medium reception tray to the first position, determining whether a length of the medium is less than a predetermined length after the recording operation is completed, and switching the medium reception tray to the second position if the length of the medium is less than the predetermined length.

The entire disclosure of Japanese Patent Application No. 2012-079656, filed Mar. 30, 2012, is expressly incorporated by reference herein.

What is claimed is:

1. A recording apparatus comprising:

a recording unit that performs a recording on a medium;

a discharge unit that discharges the medium on which the recording is performed by the recording unit;

a medium reception tray that is provided to be capable of displacing between a first position protruding in a medium discharge direction and a second position drawn in an opposite direction to the medium discharge direction and receives the medium discharged by the discharge unit;

a drive unit that drives the medium reception tray;

a control unit that controls the positions of the medium reception tray depending on a length of the medium to be discharged; and a regulation unit that is located at an inside of the recording apparatus and that regulates the medium being drawn by engaging with a trailing edge of the medium, when the medium reception tray is displaced in a direction from the first position toward the second position, wherein the regulation unit includes:

a convex portion that forms at a tray accommodation unit which accommodates the media reception tray, a tray side rib which is formed along the medium discharge direction in the medium reception tray, and wherein the convex portion is entered between the tray side ribs when the medium reception tray is accommodated in the tray accommodation unit.

2. The recording apparatus according to claim 1, wherein in a case where a length of the medium is shorter than a predetermined length, the control unit does not switch the medium reception tray from the first position to the second position and holds the tray at the first position after the discharge operation is completed.

3. The recording apparatus according to claim 1, wherein a ridge-like unit rising in a height direction from a medium reception surface which receives the medium are formed at both sides in an intersecting direction to the medium discharge direction, downstream in the medium discharge direction in the medium reception tray, wherein an inclined guide surface is formed upstream in the medium discharge direction in the ridge-like unit, and an opening portion is formed on the inclined guide surfaces, wherein a leading edge of the medium having a width greater than a predetermined width is configured to ride across the inclined guide surface, and the leading edge of the medium having a width less than a predetermined width is configured to enter the opening unit.

4. The recording apparatus according to claim 1, wherein the medium reception tray is slidably supported with a frame, the frame is configured to a base body of the recording apparatus, and the regulation unit forms at the frame.

5. The recording apparatus according to claim 4, further comprising:

a drive unit that drives the medium reception tray; and a control unit that controls the positions of the discharged sheet reception tray depending on a length of a sheet to be discharged.

6. The recording apparatus according to claim 1, further comprising:

a drive unit that drives the medium reception tray; and a control unit that controls the positions of the discharged sheet reception tray depending on a length of a sheet to be discharged.

7. A method of controlling a recording apparatus which includes a recording unit that performs recording on a medium;

a discharge unit that discharges the medium on which the recording is performed by the recording unit;

a medium reception tray that is provided to be capable of displacing between a first position protruding in a medium discharge direction and a second position drawn in an opposite direction to the medium discharge direction and receives the medium discharged by the discharge unit;

a drive unit that drives the medium reception tray;

a control unit that controls the drive unit; and a regulation unit that is located at an inside of the recording apparatus and that regulates the medium being drawn by engaging with a trailing edge of the medium, when the medium reception tray is displaced in a direction from the first position toward the second position, wherein the regulation unit includes:

a convex portion that forms at a tray accommodation unit which accommodates the media reception tray, a tray side rib which is formed along the medium discharge direction in the medium reception tray, and wherein the convex portion is entered between the tray side ribs when the medium reception tray is accommodated in the tray accommodation unit, the method comprising:

receiving a recording execution command;

determining a current position of the medium reception tray; and starting a printing operation by moving the medium reception tray to a position where a leading edge of the medium protrudes by a predetermined amount from the leading edge of the medium reception tray, based on size information of the medium.

8. A method of controlling a recording apparatus which includes a recording unit that performs recording on a medium;

a discharge unit that discharges the medium on which the recording is performed by the recording unit;

a medium reception tray that is provided to be capable of displacing between a first position protruding in a medium discharge direction and a second position drawn in an opposite direction to the medium discharge direction and receives the medium discharged by the discharge unit;

a drive unit that drives the medium reception tray;

a control unit that controls the drive unit; and a regulation unit that is located at an inside of the recording apparatus and that regulates the medium being drawn by engaging with a trailing edge of the medium, when the medium reception tray is displaced in a direction from the first position toward the second position, wherein the regulation unit includes:

a convex portion that forms at a tray accommodation unit which accommodates the media reception tray, a tray side rib which is formed along the medium discharge direction in the medium reception tray, and wherein the convex portion is entered between the tray side ribs when the medium reception tray is accommodated in the tray accommodation unit, the method comprising:

receiving a recording execution command, determining a current position of the medium reception tray, starting a recording operation by switching the medium reception tray to the first position, and moving the medium reception tray to a position where a leading edge of the medium protrudes by a predetermined amount from the leading edge of the medium reception tray, based on size information of the medium after the recording operation is completed.

* * * * *